US007369147B2

(12) United States Patent
Mochimaru et al.

(10) Patent No.: US 7,369,147 B2
(45) Date of Patent: May 6, 2008

(54) IMAGE FORMING APPARATUS AND CONTROL METHOD THEREOF

(75) Inventors: Hideaki Mochimaru, Yokohama (JP); Hideo Kikuchi, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 307 days.

(21) Appl. No.: 11/226,314

(22) Filed: Sep. 15, 2005

(65) Prior Publication Data

US 2006/0055767 A1 Mar. 16, 2006

(30) Foreign Application Priority Data

Sep. 15, 2004 (JP) ..... 2004-268719

(51) Int. Cl.
*B41J 2/435* (2006.01)

(52) U.S. Cl. ..... 347/234; 347/248

(58) Field of Classification Search ..... 347/116, 347/234–235, 248–250, 229; 399/306
See application file for complete search history.

(56) References Cited

U.S. PATENT DOCUMENTS 6,097,921 A * 8/2000 Kageyama ..... 399/306
6,574,448 B2 6/2003 Mochimaru et al.
6,584,295 B2 6/2003 Omata et al.
6,608,985 B2 8/2003 Mochimaru et al.
6,633,733 B2 10/2003 Mochimaru et al.
6,643,489 B2 11/2003 Omata et al.
6,683,634 B2 * 1/2004 Murakami ..... 347/116
6,728,505 B2 4/2004 Omata et al.
6,741,825 B2 5/2004 Omata et al.
6,801,742 B1 10/2004 Mochimaru et al.
6,898,398 B2 5/2005 Omata et al.
6,898,408 B2 5/2005 Omata et al.

(Continued)

FOREIGN PATENT DOCUMENTS

JP 2000147842 A * 5/2000

(Continued)

OTHER PUBLICATIONS

U.S. Appl. No. 10/769,844, filed Feb. 3, 2004, Omata et al.

*Primary Examiner*—Hai Pham
(74) *Attorney, Agent, or Firm*—Oblon, Spivak, McClelland, Maier & Neustadt, P.C.

(57) ABSTRACT

An image forming apparatus includes a first writing control device configured to control a writing of a first latent image, a second writing control device configured to control a writing of a second latent image, and a criterion timing determination device configured to determine a criterion timing for a series of image forming operations based on an image forming instruction and to transmit to the first writing control device one of (i) a signal of the criterion timing, or (ii) a signal of a writing instruction determined based on the criterion timing. The first writing control device is configured to start a writing process of the first latent image based on one of the signal of the criterion timing or the signal of the writing instruction received from the criterion timing determination device, and to transmit a signal of a timing for starting a writing process to the second writing control device. The second writing control device is configured to start the writing process of the second latent image based on the signal of the timing for starting the writing process received from the first writing control device.

20 Claims, 16 Drawing Sheets

U.S. PATENT DOCUMENTS

| | | | |
|---|---|---|---|
| 6,941,094 | B2 | 9/2005 | Omata et al. |
| 2002/0060804 | A1 | 5/2002 | Mochimaru et al. |
| 2003/0007812 | A1 | 1/2003 | Mochimaru et al. |
| 2004/0131398 | A1 | 7/2004 | Omata et al. |
| 2004/0223793 | A1 | 11/2004 | Omata et al. |

FOREIGN PATENT DOCUMENTS

| | | |
|---|---|---|
| JP | P3484996 | 10/2003 |

* cited by examiner

IMAGE FORMING APPARATUS AND CONTROL METHOD THEREOF

CROSS-REFERENCE TO RELATED APPLICATIONS

The present application claims priority and contains subject matter related to Japanese Patent Application No. 2004-268719 filed in the Japanese Patent Office on Sep. 15, 2004, the entire contents of which are hereby incorporated herein by reference.

BACKGROUND OF THE INVENTION

1. Field of the Invention

An image forming apparatus, such as a copying machine, a printer, a facsimile apparatus, etc., forms images on both sides of a recording medium using a one-path method, and a control method of the image forming apparatus.

2. Discussion of the Background

As methods of forming images on both sides of a recording medium, such as a transfer sheet, a switchback method and a one-path method are known. Japanese Patent No. 3484996 describes an example of the one-path method. In the switchback method, an image is formed on one side of a recording medium by causing the recording medium to pass a transfer device and then the recording medium passes a fixing device so that the image is fixed to the recording medium. Thereafter, the recording medium is returned to the transfer device and the fixing device so that another image is formed on the other side of the recording medium.

In the one-path method, visible images are transferred onto both sides of a recording medium by a both-sides transfer device, and thereafter the recording medium passes a fixing device, so that the images on both sides of the recording medium are fixed to the recording medium at the same time. The one-path method is superior in cost to the switchback method because a relatively complicated switchback mechanism is avoided.

Further, the time for forming the images on both sides of the recording medium is shorter in the one-path method because the recording medium is not returned to the transfer device and the fixing device after forming the image on one side thereof. Furthermore, in the switchback method, when the recording medium is curled by the heat of the fixing device and the curled recording medium is returned to the transfer device and the fixing device, the recording medium tends to jam. Such jamming of the recording medium is avoided in the one-path method.

In image forming apparatuses forming images on both sides of a recording medium using the one-path method, a known method uses a common latent image bearing member for forming the image on one side of the recording medium and for forming another image on the other side of the recording medium. Another known method uses separate latent image bearing members for forming the image on one side of the recording medium and for forming the other image on the other side of the recording medium.

In the method that uses the common latent image bearing member, a first latent image is formed on the latent image bearing member by optically scanning the latent image bearing member, and a first visible image is obtained by developing the first latent image. Then, the first visible image is transferred onto an intermediary transfer member, such as an intermediary transfer belt, etc. Subsequently, a second latent image is formed on the latent image bearing member, and a second visible image is obtained by developing the second latent image. Then, while the second visible image is transferred onto the backside of the recording medium, the first visible image transferred onto the intermediary transfer member is transferred onto the front side of the recording medium.

In the method that uses separate latent image bearing members, while a first visible image formed on a first latent image bearing member is transferred onto the front side of the recording medium, a second visible image formed on a second latent image bearing member is transferred onto the backside of the recording medium. In this method, because visible images for the front side and the backside of the recording medium are formed substantially simultaneously, the image formation speed is faster as compared to the method that uses the common latent image bearing member.

In the above-described method that uses separate latent image bearing members, however, there is the possibility that a deviation from a predetermined position is caused to the images on both sides of the recording medium in the conveyance direction of the recording medium. Generally, in an image forming apparatus, a main controller including a CPU, a RAM, a ROM, etc. controls a driving of a latent image bearing member, a development device, a transfer device, a sheet conveying device, etc., and a latent image writing device writing a latent image on the latent image bearing member is controlled by a separate writing controller because of the necessity of processing a large volume of information.

The main controller determines a time criterion in a series of image forming operations upon receiving an image formation instruction inputted by an operator, and based on the time criterion, drives the development device, the transfer device, etc. at appropriate timings. Further, the main controller transmits a writing instruction signal to the writing controller to determine the timing of starting a writing process. At this time, the main controller not only performs a calculation process for counting the timing for transmitting the signal of the writing instruction but also performs calculation processes for driving the development device, the transfer device, etc. at the same time.

In this case, if the calculation process for determining the timing for starting the writing process is interrupted by the calculation processes for driving the development device, etc., the timing for transmitting the signal of the writing instruction to the writing controller may be deviated from a regular timing. When (i) the timing for transmitting the writing instruction signal to the writing controller controlling writing of the latent image for the front side of the recording medium and (ii) the timing for transmitting another writing instruction signal to the writing controller controlling writing of the other latent image for the back side of the recording medium are irregularly deviated from regular timings, respectively, a deviation in the positions of resulting images is caused on both sides of the recording medium in the conveyance direction of the recording medium.

For example, the first character line of a first page of a document formed on the front side of the recording medium and the first character line of the second page of the document formed on the backside of the recording medium are not aligned with each other.

The above-described JP No. 3484996 describes a technology for suppressing the deviation in the positions of the images on both sides of the recording medium in the widthwise direction (the direction perpendicular to the conveyance direction) of the recording medium. However, JP No. 3484996 fails to disclose a technology or method for suppressing the deviation in the positions of images on both sides of the recording medium in the conveyance direction of the recording medium.

SUMMARY OF THE INVENTION

The present invention has been made in view of the above-discussed and other problems and addresses the above-discussed and other problems.

Preferred embodiments of the present invention provide a novel image forming apparatus that is capable of suppressing the deviation in the positions of images formed on both sides of a recording medium in the conveyance direction of the recording medium while forming the images on both sides of the recording medium at a relatively high speed by using individual latent image bearing members relative to the frontside and the backside of the recording medium. The preferred embodiments of the present invention further provide a novel control method of the image forming apparatus.

According to an aspect of the present invention, an image forming apparatus includes a first writing control device configured to control a writing of a first latent image; a second writing control device configured to control a writing of a second latent image; and a criterion timing determination device configured to determine a criterion timing for a series of image forming operations based on an image forming instruction and to transmit to the first writing control device one of (i) a signal of the criterion timing, or (ii) a signal of a writing instruction determined based on the criterion timing. The first writing control device is configured to start a writing process of the first latent image based on one of the signal of the criterion timing or the signal of the writing instruction received from the criterion timing determination device, and to transmit a signal of a timing for starting a writing process to the second writing control device. The second writing control device is configured to start the writing process of the second latent image based on the signal of the timing for starting the writing process received from the first writing control device.

According to another aspect of the present invention, an image forming apparatus includes a first writing control device configured to control a writing of a first latent image; a second writing control device configured to control a writing of a second latent image; and a criterion timing determination device configured to determine a criterion timing in a series of image forming operations based on an image forming instruction and to transmit substantially at the same time to the first writing control device and the second writing control device one of (i) a signal of the criterion timing, or (ii) a signal of a writing instruction determined based on the criterion timing. The first writing control device is configured to start the writing process based on one of the signal of the criterion timing or the signal of the writing instruction, transmitted by the criterion timing determination device, and the second writing control device is configured to start the writing process thereof based on one of the signal of the criterion timing or the signal of the writing instruction received by the criterion timing determination device.

According to still another aspect of the present invention, an image forming apparatus includes a first writing control device configured to control a writing of a first latent image; a second writing control device configured to control a writing of a second latent image; a feed device configured to feed a recording medium to both-sides transfer device; and a criterion timing determination device configured to determine a criterion timing in a series of image forming operations and a timing for starting feeding the recording medium from the feed device, based on an image forming instruction, and to transmit to the first writing control device any of (i) a signal of the criterion timing, (ii) a signal of a writing instruction determined based on the criterion timing, or (iii) a signal of the timing for starting feeding the recording medium. The first writing control device is configured to start a corresponding writing process based on the signal of the timing for starting feeding the recording medium transmitted by the criterion timing determination device, and to transmit a signal of a timing for starting the writing process to the second writing control device, and the second writing control device is configured to start a corresponding writing process based on the signal of the timing for starting the writing process of the first writing control device received from the first writing control device.

According to still another aspect of the present invention, an image forming apparatus includes a first writing control device configured to control a writing of a first latent image; a second writing control device configured to control a writing of a second latent image; a feed device configured to feed a recording medium to a both-sides transfer device; and a criterion timing determination device configured to determine a criterion timing in a series of image forming operations and a timing for starting feeding the recording medium from the feed device, based on an image forming instruction, and to transmit substantially at the same time to the first writing control device and the second writing control device any of (i) a signal of the timing for starting feeding the recording medium, (ii) a signal of the criterion timing, or (iii) a signal of a writing instruction determined based on the criterion timing. The first writing control device is configured to start a writing process based on the signal of the timing for starting feeding the recording medium received from the criterion timing determination device, and the second writing control device is configured to start a writing process based on the signal of the timing for starting feeding the recording medium received from the criterion timing determination device.

According to another aspect of the present invention, a method of controlling an image forming apparatus is provided. The method includes transmitting to a first writing control device one of (i) a signal of a criterion timing, or (ii) a signal of a writing instructions determined based on the criterion timing from a criterion determination device; causing the first writing control device to start a writing process based on one of the signal of the criterion timing or the signal of the writing instruction received from the criterion timing determination device, and to transmit a signal of a timing for starting the writing process to a second writing control device; and causing the second control device to start a writing process based on the signal of the timing for starting the writing process received from the first writing control device.

According to another aspect of the present invention, a method includes transmitting substantially at the same time to a first writing control device and a second writing control device one of a signal of a criterion timing or a signal of a writing instruction determined based on the criterion timing received from a criterion determination device; causing the first writing control device to start a writing process based on one of the signal of the criterion timing or the signal of the writing instruction received from the criterion timing determination device; and causing the second writing control device to start a writing process based on one of the signal of the criterion timing or the signal of the writing instruction received from the criterion timing determination device.

According to another aspect of the present invention, a method includes transmitting a signal of a timing for starting feeding a recording medium from a criterion timing determination device to a first writing control device; causing the first writing control device to start a writing process based on the signal of the timing for starting feeding the recording medium received from the criterion timing determination device, and to transmit a signal of a timing for starting the writing process to a second writing control device; and causing the second writing control device to start a writing process based on the signal of the timing for starting the writing process received from the first writing control device.

According to another aspect of the present invention, a method includes transmitting a signal of a timing for starting feeding a recording medium from a criterion timing determination device to a first writing control device and a second writing control device substantially at the same time; causing the first writing control device to start a writing process based on the signal of the timing for starting feeding the recording medium received from the criterion timing determination device; and causing the second writing control device to start a writing process based on the signal of the timing for starting feeding the recording medium received from the criterion timing determination device.

BRIEF DESCRIPTION OF THE DRAWINGS

A more complete appreciation of the present invention and many of the attended advantages thereof will be readily obtained as the present invention becomes better understood by reference to the following detailed description when considered in connection with the accompanying drawings, wherein.

DETAILED DESCRIPTION OF THE PREFERRED EMBODIMENTS

Figure 1:
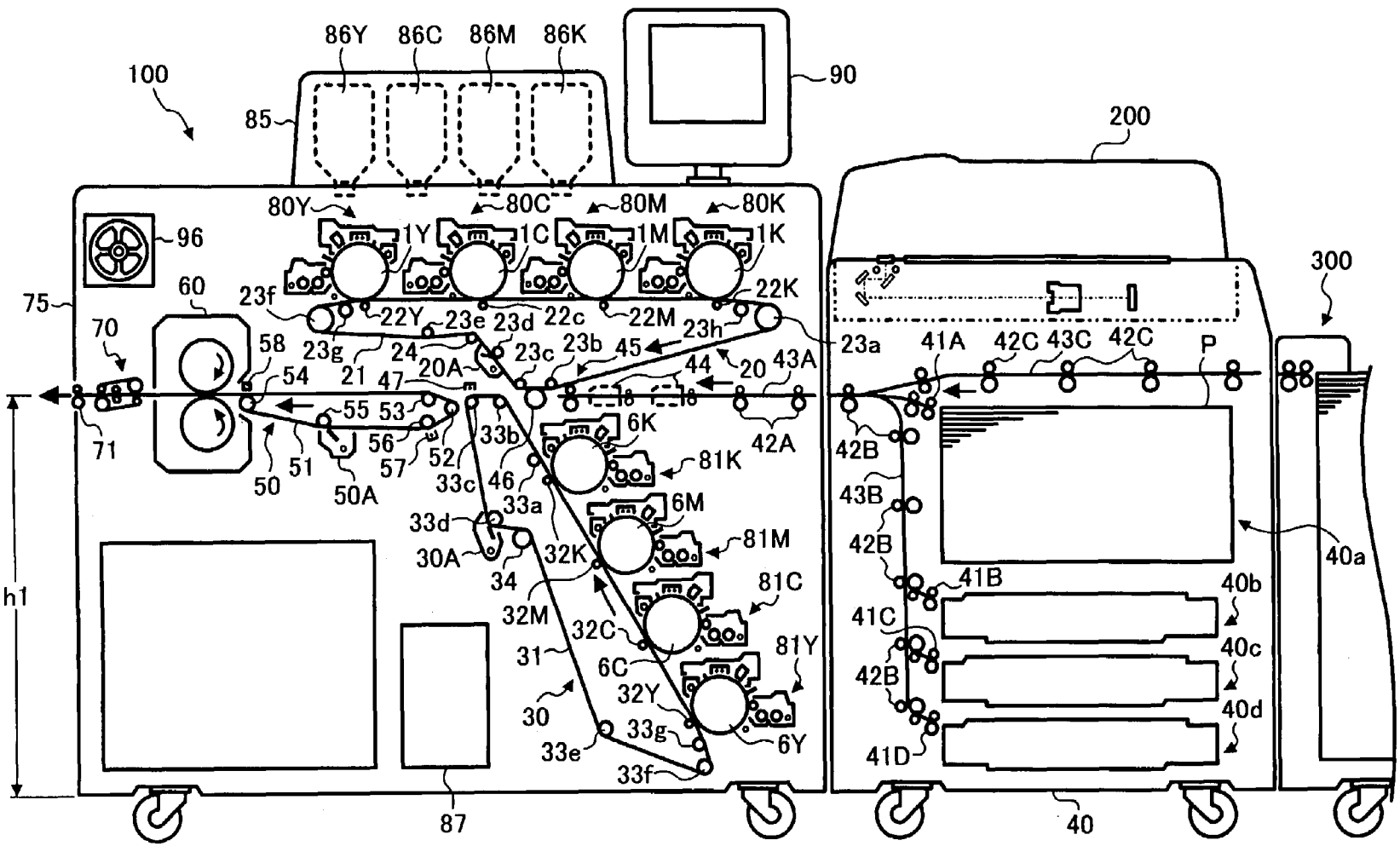
FIG. 1 is a diagram schematically illustrating a construction of an electrophotographic color copying machine according to one embodiment of the present invention.

Referring now to the drawings, wherein like reference numerals designate identical or corresponding parts throughout the several views, preferred embodiments of the present invention are described.

FIG. 1 is a diagram schematically illustrating a construction of an electrophotographic color copying machine (hereinafter referred to as the copying machine) as an example of an image forming apparatus according to an embodiment of the present invention.

The copying machine includes a printer part 100, an operation/display device 90, a sheet feed device 40, an automatic original document read device 200 and a sheet replenishment device 300.

The printer part 100 includes a sheet conveying path 43A, a first image formation part arranged above the sheet conveying path 43A, and a second image formation part arranged below the sheet conveying path 43A. The first image formation part includes a first transfer unit 20 including an endless first intermediary transfer belt 21, which is moved in a corresponding arrow direction in FIG. 1. The second image formation part includes a second transfer unit 30 including an endless second intermediary transfer belt 31, which is moved in a corresponding arrow direction in FIG. 1.

First process units 80Y, 80C, 80M, and 80K are arranged above the upper stretched part of the first intermediary transfer belt 21. Second process units 81Y, 81C, 81M, and 81K are arranged beside the side stretched part of the second intermediary transfer belt 31. Here, suffixes appended to reference numerals, Y, C, M, and K, indicate colors (yellow, cyan, magenta, and black) of a toner processed in respective process units. The suffixes are similarly appended to reference numerals of other units in each process unit.

The first process units 80Y, 80C, 80M, and 80K include first photoconductors 1Y, 1C, 1M, and 1K serving as first latent image bearing members, and the second process units 81Y, 81C, 81M, and 81K include second photoconductors 6Y, 6C, 6M, and 6K serving as second latent image bearing members. Each of the photoconductors is formed in a drum shape. The first photoconductors 1Y, 1C, 1M, and 1K are arranged at regular intervals, and are respectively configured to contact the upper stretched part of the first intermediary transfer belt 21 at least when forming images thereon. Hereinafter, parts of the surface of the first intermediary transfer belt 21, with which the first photoconductors 1Y, 1C, 1M, and 1K are brought into contact, respectively, are collectively referred to as a first image reception surface.

The second photoconductors 6Y, 6C, 6M, and 6K are also arranged at regular intervals, and are respectively configured to contact the side stretched part of the second intermediary belt 31 at least when forming images thereon. Hereinafter, parts of the surface of the second intermediary transfer belt 31, with which the second photoconductors 6Y, 6C, 6M, and 6K are brought into contact, respectively, are collectively referred to as a second image reception surface.

The first intermediary transfer belt 21 is spanned around a plurality of stretch rollers 23*a*-23*h* to be set in a landscape posture occupying the space in the horizontal direction rather than in the vertical direction and is stretched such that the first image reception surface is substantially horizontal. The first process units 80Y, 80C, 80M, and 80K are arranged substantially horizontally in a line to contact the first image reception surface.

The second intermediary transfer belt 31 is spanned around a plurality of stretch rollers 33*a*-33*e* to be set in a portrait posture occupying a space in the vertical direction rather than in the horizontal direction and is stretched such that the second image reception surface is inclined from the upper left to the lower right in FIG. 1. The second process units 81Y, 81C, 81M, and 81K are arranged at the right side of the second intermediary transfer belt 31 in FIG. 1 in a line inclined from the upper left to the lower right of FIG. 1 to contact the inclined second image reception surface.

By setting one intermediary transfer belt in a landscape posture and the other intermediary transfer belt in a portrait posture, the layout is balanced horizontally and vertically.

Figure 2:
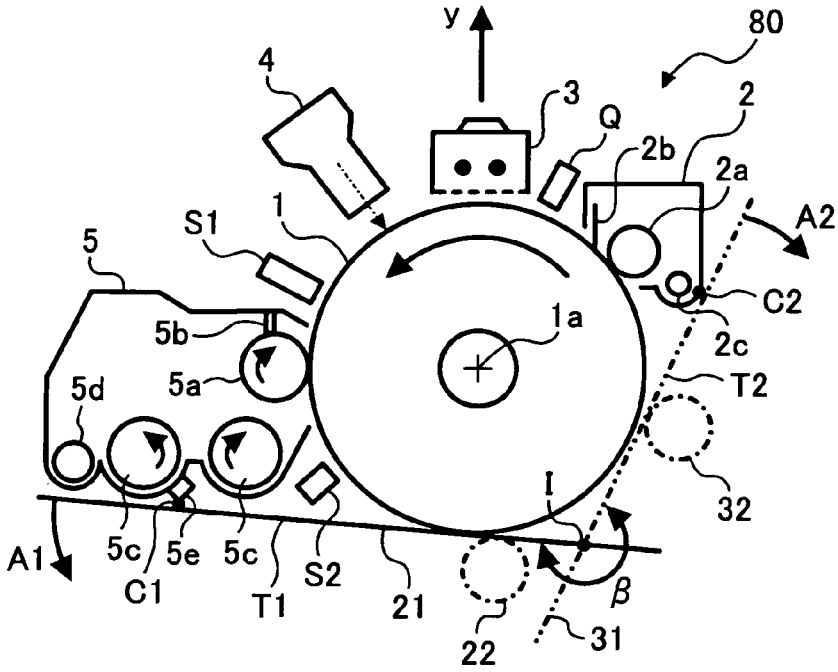
FIG. 2 is an enlarged view of one of four first process units in the printer part of the copying machine.

FIG. 2 is an enlarged view of one of the first process units 80Y, 80C, 80M, and 80K. The configurations of the first process units 80Y, 80C, 80M, and 80K are substantially the same except that the colors of toner are different, so that the suffixes Y, C, M, and K appended to reference numerals 80 and 1 are omitted in FIG. 2. The first photoconductor 1 is driven by a drive device (not shown) to rotate in the counterclockwise direction in FIG. 2 when the printer part 100 is operated. Image formation devices, such as a charging device 3, an optical writing device 4, a development device 5, a cleaning device 2, a discharger Q, etc., and an electric potential sensor S1, an image sensor S2, etc. are arranged around the photoconductor 1.

The first photoconductor 1 includes an aluminum cylinder 30-120 mm in diameter, the surface of which is covered with a layer of photoconductive material, such as an organic photoconductive (OPC) layer. The first photoconductor 1 may be the one in which the aluminum cylinder is covered with an amorphous silicon (a-Si) layer. Further, the first photoconductor 1 may be the one formed in a belt. The same applies to the second photoconductor 6 described later.

The cleaning device 2 includes a cleaning brush 2*a*, a cleaning blade 2*b*, a collecting member 2*c*, etc., and is configured to remove and to collect residual toner remaining on the surface of the first photoconductor 1 after passing a first transfer nip described later.

The charger 3 uniformly charges the surface of the first photoconductor 1, which is rotating, for example, to negative polarity. The charger 3 may be any of the known chargers in the art. Further, the method of arranging a charge bias member to contact the surface of the first photoconductor 1 and applying a charge bias voltage to the charge bias member may be used.

The optical writing device 4 optically scans the surface of the first photoconductor 1, which has been uniformly charged, with a light generated according to image data corresponding to a color, and thereby an electrostatic latent image is formed on the first photoconductor 1. In the example illustrated in FIG. 2, the optical writing device 4 using an LED (light emitting diode) array and an imaging element is used. A laser scanning system using a laser light source and a polygon mirror may be also used. In this case, the surface of the first photoconductor 1 is scanned with a laser beam light modulated according to image data.

The development device 5 employs a two-component development system, and develops the electrostatic latent image on the first photoconductor 1 with a two-component developer including toner and magnetic carriers. The two-component developer is conveyed, while being stirred, in the depth direction in FIG. 2, by two conveying screws 5*c*. The conveying directions in which the conveying screws 5*c* convey the two-component developer are opposite to each other. For example, when the conveying screw 5*c* at the left side in FIG. 2 conveys the two-component developer from the backside to this side in FIG. 2, the conveying screw 5*c* at the right side conveys the two-component developer from this side to the backside in FIG. 2. The two-component developer conveyed by the conveying screw 5*c* at the left side to an end part-of the development device 5 in the depth direction in FIG. 2 is conveyed to the conveying screw 5*c* at the right side.

Thereafter, while the two-component developer is conveyed by the conveying screw 5*c* at the right side from the end part of the development device 5 to an opposite end part thereof, a part of the two-component developer is born on a development roller 5*a* of the development device 5. The two-component developer including the one that has not been born on the development roller 5*a* and the one returned from the development roller 5*a* to the conveying screw 5*c* at the right side is conveyed to the conveying screw 5*c* at the left side at the opposite end part of the development device 5.

Thus, the two-component developer is circulated in the development device 5. A one-component development system using a single component developer (which includes toner as a primary component, without including magnetic carriers) may be also used for the development device 5.

Figure 3:
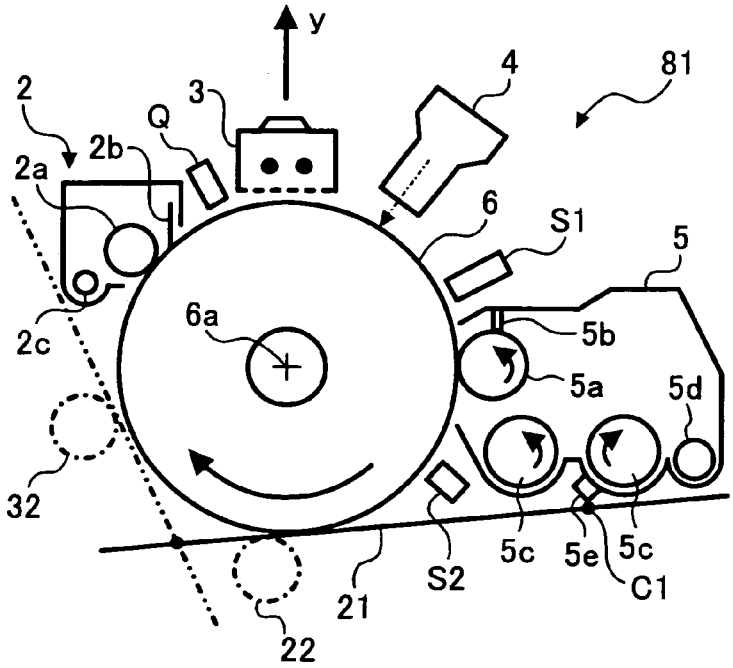
FIG. 3 is an enlarged view of one of four second process units in the printer part of the copying machine.

The development roller 5*a* includes a sleeve, which is a non-magnetic cylinder formed of stainless steel, aluminum, etc. and is driven by a drive device (not shown) to rotate in the clockwise direction in FIG. 3, and a magnet roller arranged and fixed inside of the sleeve. The magnet roller has a plurality of magnetic poles divided in the circumferential direction thereof. The two-component developer being conveyed by the conveying screw 5*c* at the right side is attracted by a magnetic force generated by the magnet roller of the development roller 5*a* and is scooped up to a surface of the rotating sleeve of the development roller 5*a*.

The two-component developer carried on the surface of the rotating sleeve of the development roller 5*a* passes a restriction position where the two-component developer carried on the surface of the rotating sleeve of the development roller 5*a* opposes a blade 5*b* before being conveyed to a development area where the carried two-component developer opposes the first photoconductor 1.

The blade 5*b* is arranged with a tip end thereof spaced a predetermined distance from the surface of the sleeve of the development roller 5*a*. When the two-component developer on the surface of the sleeve of the development roller 5*a* passes the restriction position just below the tip end of the blade 5*b*, the thickness of the two-component developer on the sleeve of the development roller 5*a* is regulated to have a predetermined thickness.

The two-component developer on the sleeve of the development roller 5*a* regulated in thickness as described above is conveyed to the development area opposing the first photoconductor 1 with a rotation of the sleeve of the development roller 5*a*. On the other hand, an electrostatic latent image, which has been formed on the first photoconductor 1 by attenuating the electric potential of the surface of the first photoconductor 1 uniformly charged to a negative polarity by optical scanning thereof, is caused to slidably contact the two-component developer carried on the surface of the sleeve of the developer roller 5*a*. At this time, toner of the two-component developer, having the same negative polarity as that of the electrostatic latent image, adheres to the latent image, and thereby the latent image is developed into a visible toner image in a color of the toner, that is, yellow, cyan, magenta or black. A reversal development is performed in the first process units 80Y, 80C, 80M, and 80K. Thus, a first toner image as a first visible image in yellow, cyan, magenta or black is formed on the first photoconductor 1.

Spherical or amorphous toner that can be obtained by a known method may be used for the toner of the two-component developer. The toner has preferably a volume average particle diameter of 20 μm or smaller, preferably 10 μm or smaller and 4 μm or greater. Magnetic carriers that can be obtained by a known method may be used for the magnetic carriers of the two-component developer. The magnetic carriers preferably have the volume average particle diameter of about 25-60 μm.

The two-component developer on the surface of the sleeve of the development roller 5*a*, after passing the development area by the rotation of the sleeve of the development roller 5*a* and the toner of which has been consumed in the development area, is removed from the surface of the sleeve under the influence of a repulsive magnetic field formed by neighboring magnetic poles of the same polarity of the magnet roller and is returned onto the conveying screw 5*c* at the right side. Thereafter, the two-component developer is conveyed to the conveying screw 5*c* at the left side.

A toner density sensor 5*e* is arranged below the conveying screw 5*c* at the left side, and detects the permeability of the two-component developer being conveyed by the conveying screw 5*c* at the left side. The permeability of the two-component developer depends with the toner density, so that the toner density sensor 5*e* detects the toner density of the two-component developer.

A print controller (not shown) determines if the toner density of the two-component developer is below a predetermined threshold value based on an output signal from the toner density sensor 5*e*, and when it has been determined that the toner density is below the threshold value, the print controller drives a toner supply device corresponding to the development device 5 among eight toner supply devices (not shown) for a predetermined period of time. These eight toner supply devices correspond to four development devices of the first process units 80Y, 80C, 80M, and 80K and four development devices of the second process units 81Y, 81C, 81M, and 81K. Each toner supply device is connected to a corresponding one of toner bottles 86Y, 86C, 86M, and 86K detachably set in a bottle accommodation part 85 arranged above the printer part 100 (FIG. 1). Toner of predetermined color is supplied from the connected toner bottle 86Y, 86C, 86M or 86K onto the conveying screw 5*c* at the left side in the development device 5. Thereby, the toner density of the two-component developer in the development device 5, the toner of which has been consumed in development, is recovered.

A system of sucking toner in a toner bottle and conveying the toner to a development device by a suction force of a known Monoe pump may be used for the toner supply device. Such a system using the Monoe pump has little restriction in the place of arranging the toner bottle, so that it is advantageous in allocating the internal space of the printer part 100. Further, because the toner can be supplied as appropriate, a large toner storage space is not needed in the development device 5, so that the development device 5 can be made compact.

FIG. 3 is an enlarged view of one of the second process units 81Y, 81C, 81M, and 81K. The configurations of the second process units 81Y, 81C, 81M, and 81K are substantially the same except that the colors of the toner are different, so that the suffixes Y, C, M, and K appended to reference numerals 81 and 6 are omitted. Further, configurations of the second process units 81Y, 81C, 81M, and 81K are substantially the same as those of the first process units 80Y, 80C, 80M, and 80K except that the directions in which the photoconductors rotate are different. Components of the first process unit (80Y, 80C, 80M, 80K) and those of the second process unit (81Y, 81C, 81M, 81K) are arranged symmetrically relative to each other with the axis "y" passing a rotation axis (1*a*, 6*a*) of the photoconductor (1, 6) as the reference line.

Such arrangement of the components has been determined considering connection parts relative to the main body of the printer part 100, such as connection parts relative to drive devices, electrical connection parts, and connection methods of toner supply parts and toner discharge parts. Thereby, a compatibility is realized between the components of the first process units 80Y, 80C, 80M, and 80K and those of the second process units 81Y, 81C, 81M, and 81K.

Accordingly, it is not necessary to manufacture development devices, cleaning devices, and parts for the first process units 80Y, 80C, 80M, and 80K and the second process units 81Y, 81C, 81M, and 81K, individually, so that a relatively high efficiency can be obtained in manufacturing and management of the parts, and thereby an overall cost reduction is achieved.

In FIG. 1, the first image formation part includes the first process units 80Y, 80C, 80M, and 80K, and the first transfer unit 20. The second image formation part includes the second process unit 81Y, 81C, 81M, and 81K, and the second transfer unit 30.

In the first transfer unit 20, the first intermediary transfer belt 21 is spanned around stretching rollers 23*a*, 23*b*, 23*c*, 23*d*, 23*e*, 23*f*, 23*g*, and 23*h*, and is moved in the clockwise direction in FIG. 1. The first intermediary transfer belt 21 is caused to contact the first photoconductors 1Y, 1C, 1M, and 1K of the first process units 80Y, 80C, 80M, and 80K. Thereby, first transfer nips are formed for transferring first toner images of yellow, cyan, magenta, and black on the first photoconductors 1Y, 1C, 1M, and 1K onto the first intermediary transfer belt 21 while superimposing one on top of another.

First transfer rollers 22Y, 22C, 22M, and 22K are arranged at the first transfer nips to sandwich the first intermediary transfer belt 21 with the first photoconductors 1Y, 1C, 1M, and 1K, and first transfer bias voltages are applied to the first transfer rollers 22Y, 22C, 22M, and 22K by a power source (not shown). The first toner images of yellow, cyan, magenta, and black on the first photoconductors 1Y, 1C, 1M, and 1K are transferred onto the first intermediary transfer belt 21 while being superimposed on top of each other under the influence of the first transfer bias voltages and the pressure at the transfer nips. Thereby, superimposed first toner images of four colors are formed on the first intermediary transfer belt 21.

A cleaning device 20A is arranged at the periphery of the first intermediary transfer belt 21 to oppose the stretching roller 23*d*. The cleaning device 20A removes residual toner and an alien substance, such as paper dust, remaining on the surface of the first intermediary transfer belt 21 after passing the first transfer nips and a secondary transfer nip (a first transfer part) described later. Members related to the first intermediary transfer belt 21 are integrated with each other to construct the first transfer unit 20, and the first transfer unit 20 is configured to be detachable relative to the printer part 100.

In the second transfer unit 30, the second intermediary transfer belt 31 is spanned around stretching rollers 33*a*, 33*b*, 33*c*, 33*d*, 33*e*, 33*f*, and 33*g*, and is moved in the counterclockwise direction in FIG. 1. The second intermediary transfer belt 31 is caused to contact the second photoconductor 6Y, 6C, 6M, and 6K of the second process units 81Y, 81C, 81M, and 81K. Thereby, first transfer nips are formed for transferring second toner images of yellow, cyan, magenta, and black on the second photoconductors 6Y, 6C, 6M, and 6K onto the second intermediary transfer belt 31 while superimposing one on top of another. First transfer rollers 32Y, 32C, 32M, and 32K are arranged at the first transfer nips to sandwich the second intermediary transfer belt 31 with the second photoconductors 6Y, 6C, 6M, and 6K, and first transfer bias voltages are applied to the first transfer rollers 32Y, 32C, 32M, and 32K by a power source (not shown).

The second toner images of yellow, cyan, magenta, and black on the second photoconductors 6Y, 6C, 6M, and 6K are transferred onto the second intermediary transfer belt 31 while being superimposed on top of each other under the influence of the first transfer bias voltages and the pressure at the transfer nips. Thereby, superimposed second toner images of four colors are formed on the second intermediary transfer belt 31.

A cleaning device 30A is arranged at the periphery of the second intermediary transfer belt 31 to oppose the stretching roller 33*d*. The cleaning device 30A removes residual toner and an alien substance, such as paper dust, remaining on the surface of the second intermediary transfer belt 31 after passing the first transfer nips and a second transfer part described later. Members related to the second intermediary transfer belt 31 are integrated with each other to construct the second transfer unit 30, and the second transfer unit 30 is configured to be detachable relative to the printer part 100.

Heretofore, a belt, in which a surface layer of fluorine resin having a good releasing property relative to the toner is coated on a base layer of fluorine resin, polycarbonate resin, polyimide resin, etc., has been used for the first and second intermediary transfer belts 21 and 31. However, because such a belt has a relatively high hardness, when transferring a toner image from the belt onto a recording medium to obtain an image on the recording medium at the secondary transfer nip as described later, the toner image is compressed, so that a phenomenon that a part of the image on the recording medium is omitted (e.g., a part of a character in the image is omitted) tends to be caused.

Further, when a recording medium having poor surface smoothness, such as Japanese paper, is used, because the degree of contact between the belt and the recording medium is not sufficient, omission of a part of an image is easily caused.

Furthermore, if the pressure at the secondary transfer nip is increased to improve the degree of contact between the belt and the recording medium, toner is agglomerated, so that an omission of a part of the image tends to be caused more easily.

Figure 4:
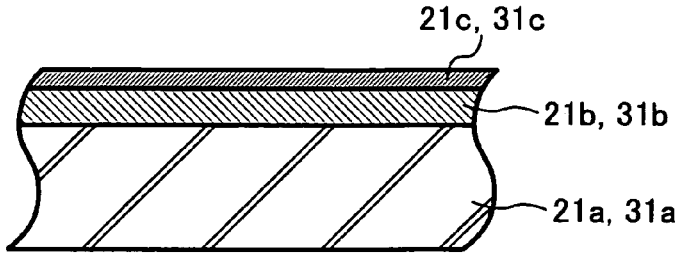
FIG. 4 is a diagram illustrating the construction of a belt used for the first intermediary transfer belt and the second intermediary transfer belt of the printer part.

FIG. 4 illustrates the construction of a belt used for the first intermediary transfer belt 21 and the second intermediary transfer belt 31 (hereinafter, referred to simply as the intermediary transfer belt) in this embodiment. As illustrated in FIG. 4, the intermediary transfer belt has a three-layer configuration, and includes a base layer (21*a*, 31*a*), an elastic layer (21*b*, 31*b*) covering the base layer (21*a*, 31*a*), and a surface layer (21*c*, 31*c*) covering the elastic layer (21*b*, 31*b*).

The base layer (21*a*, 31*a*) is made of, for example, resin having poor elasticity, and is about 50-600 μm in thickness. The base layer (21*a*, 31*a*) may be formed by fixing a material having poor elasticity, e.g., canvas, to a rubber material having good elasticity. Polycarbonate resin, fluorine resin (ETFE, PVDF, etc.), polyamide resin, modified polyphenyleneoxide resin, etc. may be used for the material having poor elasticity. A mixture of two or more of these materials can be also used. In a belt member having the multi-layer configuration, the base layer is the thickest layer.

The elastic layer (21*b*, 31*b*) is made of elastic rubber and an elastomer. Urethane rubber, fluorine rubber, acrylonitrile-butadiene copolymer rubber, butyl rubber, acrylic rubber, EPDM, NBR, acrylonitrile-butadiene-styrene rubber, natural rubber, isoprene rubber, etc. may be used as the elastic rubber. Thermoplastic polystyrene, polyolefin, polyvinyl chloride, polyurethane, polyamide, polyester, fluorine resin, etc., may be used as the elastomer. A mixture of two or more of these materials can be also used.

It is preferable that the elastic layer (21*b*, 31*b*) is not excessively thick. If the elastic layer (21*b*, 31*b*) is too thick, although it depends on the hardness thereof, the expansion and contraction ratio of the elastic layer (21*b*, 31*b*) relative to the whole part of the belt becomes too large, and thereby cracking may be caused in the belt or an adverse effect may be caused in an image by expansion and contraction of the elastic layer (21*b*, 31*b*).

The hardness degree HS of the elastic layer (21*b*, 31*b*) is preferably adjusted between 10 degree and 65 degree (JIS-A). The most appropriate hardness may be different depending upon the thickness of the elastic layer (21*b*, 31*b*). However, if the hardness degree is below 10 degree, a molding the belt in precise dimensions is difficult. This is because the belt easily contracts and expands in molding.

A method of including an oil component in the base material is generally used to decrease the hardness degree. However, when the belt is continuously operated in a state that the belt is pressed, the oil component is exuded. The exuded oil component may contaminate the photoconductor contacting the surface of the belt, and thereby a lateral strip-shaped unevenness may be caused in an image.

To prevent the oil component from being exuded from the elastic layer (21*b*, 31*b*), the surface layer (21*c*, 31*c*) provided on the elastic layer (21*b*, 31*b*) to accelerate a release of the toner must be made of a material superior in durability. This leads to a limitation of the freedom in selecting a material for the surface layer (21*c*, 31*c*). On the other hand, if the hardness degree is made greater than 65 degree (JIS-A), as described above, the omission of the part of the image is easily caused. Further, a freedom in spanning the belt in various shapes is decreased.

Thus, it is preferable that a counter measure is taken for suppressing an expansion of the elastic layer (21*b*, 31*b*). For example, the base layer (21*a*, 31*a*) may be formed having a low elasticity. The base layer (21*a*, 31*a*) may be formed having a low elasticity by using a material having a low elasticity, or by mixing a core material low in elasticity, such as canvas, in a rubber material superior in elasticity, as described above. As the core material, a threadlike material or a woven cloth material made of one or more materials selected from the following may be used: natural fibers (cotton and silk), inorganic fibers, such as a polyester fiber, a nylon fiber, an acrylic fiber, a carbon fiber, a glass fiber, a boron fiber, etc., and metal fibers, such as an iron fiber, a copper fiber, etc.

The threadlike material may be any type of twisted thread, such as the one in which one or more filaments are twisted, a one-side-twisted thread, a double-one-side-twisted thread, a two-ply thread, etc. Further, a blended thread of the above-described fibers may be also used. Furthermore, the thread may be appropriately processed to be conductive. A woven cloth woven by any method, such as a knitted cloth, may be used for the woven cloth material. A woven cloth of mixed fibers may be also used. Further, the woven cloth may be processed to be conductive.

An electric resistance adjuster may be appropriately dispersed in the base layer (21*a*, 31*a*) and the elastic layer (21*b*, 31*b*). As the electric resistance adjuster, metal powder, such as carbon black, graphite, aluminum, nickel, etc., and conductive metal oxide, such as tin oxide, titanium oxide, antimony oxide, indium oxide, potassium titanate, a compound oxide of antimony oxide and tin oxide (ATO), a compound oxide of indium oxide and tin oxide (ITO), etc., may be used. Further, the base layer (21*a*, 31*a*) and the elastic layer (21*b*, 31*b*) may be covered by insulating fine particles, such as barium sulfate, magnesium silicate, calcium carbonate, etc.

The surface layer (21*c*, 31*c*) is made of a material having a superior toner releasing property, and demonstrates superior surface smoothness. As the material having a superior toner releasing property, polyurethane, polyester, epoxy resin, fluorine resin, etc. may be used. The surface layer (21*c*, 31*c*) may be the one in which a fluorine compound, fluorocarbon, titanium oxide, silicon carbide, etc. are dispersed in the base material. Further, the surface layer (21*c*, 31*c*) may be one in which the surface energy has been made small by forming a fluorine layer on the surface thereof with heat processing, as the fluorine rubber material.

The intermediate transfer belt (21, 31) is configured to demonstrate the electric resistance of about $10^6$-$10^{12}\Omega$ cm. Ribs are arranged at one or both sides of the belt to prevent the belt from being shifted and to stabilize a conveyance thereof.

The intermediary transfer belt having a three-layer construction as described above may be manufactured by a centrifugal molding method in which the material is cast into a rotating cylinder-type mold to be formed in a belt. A spray coating method may be used to form a thin film on the surface layer. Further, other methods may be used, such as a dipping method in which a mold of a cylinder type is dipped in the solution and is pulled up, a casting method in which the material is cast in an inner side mold and an outer side mold, and a method in which a compound is wound around a cylinder type mold and vulcanization polishing is performed.

In the copying machine using the above-described intermediary transfer belt, because of the superior elasticity of the elastic layer (21*b*, 31*b*), the surface side of the intermediary transfer belt is caused to be freely transformed along the surface of a transfer sheet P at the secondary transfer nip (the first transfer part described later) by the nip pressure. Due to this transformation of the surface side of the intermediary transfer belt, the contact between the surface of the transfer sheet P and that of the intermediary transfer belt is increased without excessively increasing the nip pressure. Therefore, even when a recording medium having a poor surface smoothness is used as the transfer sheet P, a satisfactory image having no partial omission is obtained on the recording medium.

A metal roller, the surface of which has been covered by a conductive rubber material, may be used for the first transfer rollers 22Y, 22C, 22M, and 22K of the first transfer unit 20 and the second transfer rollers 32Y, 32C, 32M, and 32K of the second transfer unit 30. A bias voltage is applied to a metal core of each roller by the electric source (not shown). In this embodiment, urethane rubber, in which carbon has been dispersed to adjust the volume resistance to about $10^5\Omega$ cm, is used as the conductive rubber material.

The printer part 100 can output a black-and-white image using only black (K) toner. When outputting a black-and-white image, the first process units 80Y, 80C, and 80M of the first image formation part are not operated. A mechanism is provided to maintain the first process units 80Y, 80C, and 80M separated from the first intermediary transfer belt 21. An internal frame (not shown) supporting the roller 23*g* and the first transfer rollers 22Y, 22C, 22M, and 22K is configured to be rotated around a point so that only the first photoconductor 1K of the first process unit 80K contacts the first intermediary transfer belt 21.

A black-and-white image can be obtained by executing image formation while causing only the first photoconductor 1K to contact the first intermediary transfer belt 21 by this mechanism. This configuration is advantageous in increasing the life of the photoconductors 1Y, 1C, and 1M. The second transfer unit 30 is similarly configured such that the second process units 81Y, 81C, and 81M are separated from the second intermediary transfer belt 31 when outputting a black-and-white image.

A secondary transfer roller 46 is arranged to contact the surface of the first intermediary transfer belt 21 at the outer periphery of the first intermediary transfer belt 21. Thereby, the secondary transfer nip, where the first intermediary transfer belt 21 and the secondary transfer roller 46 contact each other, is formed in the first transfer unit 20. The secondary transfer nip constitutes the first transfer part of the both-sides transfer device of the copying machine, constituted by the first transfer unit 20 and the second transfer unit 30.

The secondary transfer roller 46 may include a metal roller, the surface of which is covered by a conductive rubber, and a secondary transfer bias voltage is applied to the metal core thereof by the electric source (not shown). Carbon is dispersed in the conductive rubber to adjust the volume resistance thereof to about $10^7\Omega$ cm.

A registration roller pair 45 is arranged at the right side of the secondary transfer nip in FIG. 1. The registration roller pair 45 temporarily stops rotating after pinching the transfer sheet P conveyed from the sheet feed device 40 arranged at the right side of the printer part 100 in FIG. 1. Then, the registration roller pair 45 feeds the transfer sheet P toward the secondary transfer nip synchronized with the superimposed first toner images of four colors on the intermediary transfer belt 21. The first side of the transfer sheet P, which is upward faced in FIG. 1, is caused to closely contact the superimposed first toner images of four colors on the first intermediary transfer belt 21 at the secondary transfer nip, and under the influence of the secondary transfer bias voltage and the nip pressure, the superimposed first toner images of four colors are transferred onto the first side of the transfer sheet P. The transfer sheet P after passing the secondary transfer nip separates from the first intermediary transfer belt 21 and the secondary transfer roller 46 and is conveyed to the second intermediary transfer belt 31.

In the second transfer unit 30, a transfer charger 47 is arranged at a position opposing the stretching roller 33*c* located at the leftmost position among the plurality of stretching rollers of the second intermediary transfer belt 31, spaced a predetermined distance from the surface of the second intermediary transfer belt 31. The area where the transfer charger 47 and the stretching roller 33*c* oppose each other via the second intermediary transfer belt 31 constitute the second transfer part of the both-sides transfer device of the copying machine.

The transfer charger 47 may be of a known type in which a discharge electrode of a thin tungsten or gold wire is held within a casing and a transfer current is applied to the discharge electrode by the electric source (not shown). The transfer sheet P conveyed from the first transfer part to the second intermediary transfer belt 31 is conveyed from the right side to the left side in FIG. 1 as the second intermediary transfer belt 31 is moved, with the second side thereof closely contacted with the surface of the second intermediary transfer belt 31.

When the transfer sheet P passes the second transfer part, an electric charge is applied to the first side of the transfer sheet P by the transfer charger 47, and thereby superimposed second toner images of four colors on the second intermediary transfer belt 31 are transferred onto the second side of the transfer sheet P. The polarity of the secondary transfer bias voltage and the electric charge applied by the transfer charger 47 is positive, opposite that of the toner.

In the sheet feed device 40 arranged at the right side of the printer part 100 in FIG. 1, a plurality of trays or cassettes, each accommodating transfer sheets P, are arranged. In this embodiment, a large volume sheet feed tray 40*a* accommodating a large volume of transfer sheets P is arranged at an upper level and three sheet feed cassettes 40*b*, 40*c*, and 40*d* are arranged below the large volume sheet feed tray 40*a* such that each can be drawn toward this side in the direction perpendicular to the sheet surface.

Transfer sheets P of different types may be accommodated in the large volume sheet feed tray 40*a* and the sheet feed cassettes 40*b*, 40*c*, and 40*d*, respectively. One piece of the transfer sheet P is selectively fed out from among uppermost transfer sheets P in the large volume sheet feed tray 40*a* and the sheet feed cassettes 40*b*, 40*c*, and 40*d* by the corresponding one of feed/separation devices 41A, 41B, 41C, and 41D, and the selectively fed out transfer sheet P is conveyed by a plurality of conveying roller pairs 42B to a sheet conveying path 43B and the sheet conveying path 43A.

The registration roller pair 45 is arranged at the sheet conveying path 43A to determine the timing of feeding out the transfer sheet P toward the first transfer part and the second transfer part. Further, a lateral registration correction mechanism 44 is provided at the sheet conveying path 43A upstream of the registration roller pair 45 to correct slanting of the transfer sheet P being conveyed from the sheet feed device 40 to the both-sides transfer device (the first transfer unit 20 and the second transfer unit 30) relative to the conveyance direction of the transfer sheet P and to position the transfer sheet P correctly in the perpendicular direction relative to the conveyance direction of the transfer sheet P.

The lateral registration correction mechanism 44 may be configured by, for example, a criterion guide relative to one side of the transfer sheet P in the conveyance direction of the transfer sheet P, and a slanted conveying roller pair. The criterion guide is movable to a predetermined position according to the size of the transfer sheet P. The transfer sheet P is conveyed by the slanted conveying roller pair to be pressed against the criterion guide, and thereby slanting of the transfer sheet P relative to the conveyance direction of the transfer sheet P is corrected and the transfer sheet P is aligned with the predetermined position.

The lateral registration correction mechanism 44 may be configured by a pair of guide plates arranged to be aligned with each other and movable in the direction perpendicular to the conveyance direction of the transfer sheet P. The pair of guide plates are moved to predetermined positions according to the size of the transfer sheet P to jog the transfer sheet P at both sides of the transfer sheet P in the conveyance direction of the transfer sheet P, several times, and thereby slanting of the transfer sheet P is corrected and the transfer sheet P is positioned in the predetermined position.

In the sheet feed device 40, the transfer sheet P fed from the large volume sheet feed tray 40*a* arranged at the uppermost position is conveyed to the sheet conveying path 43A substantially horizontally, without being bent. Therefore, even when a transfer sheet P is relatively thick or a board having a relatively high rigidity, by accommodating the transfer sheet P in the large volume sheet feed tray 40*a*, the transfer sheet P can be reliably conveyed to the sheet conveying path 43A. It is preferable that an air feed system using a vacuum mechanism is used for the large volume sheet feed tray 40*a* so that even when the transfer sheets P of a variety of types are accommodated in the large volume sheet feed tray 40*a*, the transfer sheets P can be reliable fed. Sensors (not shown) are arranged at appropriate locations along the sheet conveying path 43A to detect the transfer sheet P for generating a trigger for various signals based on the existence of the transfer sheet P.

A second sheet conveying path 43C is provided above the large volume sheet feed tray 40*a*, and a transfer sheet P can be conveyed to the second sheet conveying path 43C from a second sheet feed device 300 arranged at the right side of the sheet feed device 40 in FIG. 1.

A sheet conveyance unit 50 is arranged at the left side of the second transfer unit 30 in FIG. 1, in which an endless sheet conveyance belt 51 is spanned around a plurality of stretching rollers 52, 53, 54, 55, and 56 to be moved in the counterclockwise direction in FIG. 1. The sheet conveyance belt 51 receives thereon the transfer sheet P discharged from the second transfer part of the second transfer unit 30 at the part thereof spanned around the stretching roller 52 arranged at the rightmost position in the plurality of stretching rollers. An electrostatic adsorption charger 57 applies an electric charge to the front surface of the sheet conveyance belt 51 before the transfer sheet P is received thereon. Thereby, the transfer sheet P can be electrostatically adsorbed to the front surface of the sheet conveyance belt 51.

The sheet conveyance belt 51 with the transfer sheet P electrostatically adsorbed to the front surface thereof conveys the transfer sheet P from the right side to the left side in FIG. 1 as the sheet conveyance belt 51 is moved. The transfer sheet P is then conveyed to a fixing device 60 arranged at the left side of the sheet conveyance unit 50 in FIG. 1. An electric charge is applied by a separation charger 58 to the transfer sheet P electrostatically adsorbed to the front surface of the sheet conveyance belt 51 before the transfer sheet P is conveyed to the fixing device 60.

Thereby, the transfer sheet P electrostatically adsorbed to the surface of the sheet conveyance belt 51 can be easily separated from the surface of the sheet conveyance belt 51. The transfer sheet P separates from the sheet conveyance belt 51 at the part thereof spanned around the stretching roller 54 arranged most closely to the fixing device 60 and being changed in the moving direction thereof along the curvature of the stretching roller 54, and is then received by the fixing device 60.

Various systems may be adopted for the fixing device 60, such as the one in which a heater is provided in a fixing roller, one in which a heated belt is moved, one employing induction heating, etc. In this embodiment, two fixing rollers contacting each other forms a fixing nip, and when a transfer sheet P passes the fixing nip, the transfer sheet P is heated by the two fixing rollers at both sides of the transfer sheet P, and thereby the first toner image and the second toner image on both sides of the transfer sheet P are fixed. To make the colors and brilliances of the toner images on both sides of the transfer sheet P substantially the same, the material, the hardness, and the surface characteristics of the two fixing rollers are made substantially the same.

Further, various parameters of the fixing device 60 are controlled such that most suitable fixing conditions are obtained relative to each side of the transfer sheet P depending upon whether the toner image thereon is a full color image or a black-and-white image and whether the transfer sheet P carries the toner image on one side only or each side thereof.

The transfer sheet P is conveyed toward a discharge path after passing the fixing device 60. A cooling belt unit pair 70 having a cooling function is arranged in the discharge path to cool the transfer sheet P after passing the fixing device 60 so that the unstable condition of the toner images thereon is promptly stabilized. The cooling belt unit pair 70 may be constituted of a pair of belt units, each configured to cool a belt using a roller of a heat-pipe configuration having a heat radiation part. Respective belts of the pair of belt units contact each other, and contacting parts of the belts are moved in the same direction. The cooling belt unit pair 70 cools the transfer sheet P sandwiched between the contacting parts of the belts, while conveying the transfer sheet P from the right side to the left side in FIG. 1, by heat absorption with the belts.

The transfer sheet P is then discharged by a discharge roller pair 71 to a discharge/stack part 75 provided at the left side of the printer part 100 in FIG. 1 and is stacked there. The discharge/stack part 75 employs a mechanism in which a receive member is moved by an elevator mechanism (not shown) upward and downward according to the height of stacked sheets within a height h1. A separate sheet processing apparatus may be arranged so that the transfer sheet P is conveyed thereto passing the discharge/stack device 75. As the sheet processing apparatus, a bookbinding apparatus performing punching, cutting, folding, binding, etc. may be provided.

The toner bottles 86Y, 86C, 86M, and 86K, containing unused toners of respective colors, are detachably accommodated in the bottle accommodation part 85 provided to the upper surface of the printer part 100. The bottle accommodation part 85 is arranged at the depth side of the printer part 100, and a flat surface part is provided at this side at the upper surface of the printer 100 to serve as a working table. Toner is supplied as necessary to each development device by the above-described toner supply mechanism.

In this embodiment, each of the toner bottles 86, 86C, 86M, and 86K supplies toner to respective development devices of the first image formation part and the second image formation part, using the same toner. However, separate toner bottles may be provided for supplying toner of respective colors to the development devices of the first image formation part and the second image formation part. Further, the toner bottle 86K containing frequently consumed black toner may be configured to contain a large volume of toner.

The operation/display unit 90 provided to the upper surface of the printer part 100 includes a keyboard, a display, etc., and conditions for forming images can be input. Information is displayed on the display, so that communication between the operator and the printer part 100 is facilitated.

A discarded toner container 87 is provided inside of the printer part 100 to be connected with the cleaning device 2 of each process unit, the cleaning devices 20A and 30A of the intermediary transfer belts 20 and 30, and a cleaning device 50A of the sheet conveyance unit 50. Discarded toner and alien substances, such as paper dust, conveyed from these cleaning devices are collected and accommodated in the discarded toner container 87. Because a discarded toner container is not provided to each of the cleaning devices 2, 20A, 30A, and 50A and instead the discarded toner container 87 having a relatively large capacity is provided separately, each of the cleaning devices 2, 20A, 30A, and 50A is made relatively compact, and further, the operability of disposing the discarded toner is relatively good. A sensor (not shown) is provided to detect that the discarded toner container 87 has been filled with discarded toner, and further, a warning message is generated to instruct the operator to dispose the discarded toner contained in the discarded toner container 87 or to replace a container of the discarded toner container 87.

The print controller (not shown) provided inside of the printer part 100 accommodates various electric sources, control boards, etc., which are protected by a metal frame. Because the temperature increases inside of the copying machine due to the heat generated by the fixing device 60 and various electrical components, a fan 96 is provided in the printer part 100 to avoid the performance of various members from being decreased due to the heat. The fan 96 is connected with the heat radiation part of the cooling belt unit pair 70, so that the cooling effect by the cooling belt unit pair 70 is surely obtained.

The automatic original document feed/read device 200 is provided above the sheet feed device 40. The automatic original document feed/read device 200 reads an image of an original document while feeding the original document, and read information is transmitted to the print controller. The printer part 100 is controlled to operate according to the read information, so that the same image as that of the original document is output. Image information may be transmitted from a personal computer to the printer part 100 to output an image corresponding to the image information. Further, image information may be transmitted to the printer part 100 via a telephone line (not shown) to output an image corresponding to the image information. As described above, the second sheet feed device 300 is provided at the right side of the sheet feed device 40 in FIG. 1 to feed a transfer sheet P to the second sheet conveyance path 43C of the sheet feed device 40.

The sheet conveyance path from the feed position by the registration roller pair 45 to the discharge position by the discharge roller pair 71 is formed in a straight conveyance path with no upward or downward bending as illustrated in FIG. 1. Thereby, jamming of a transfer sheet P in the process of transferring and fixing can be greatly suppressed.

When the need arises for maintenance and/or replacement of parts, an outer cover (not shown) may be opened.

Now, an operation of forming a full color image on one side of the transfer sheet P at the printer part 100 is described.

A full color image can be formed on one side of the transfer sheet P by one of two methods, which can be selected. In one method, superimposed toner images of four colors on the first intermediary transfer belt 21 are transferred onto the first side (upward faced in FIG. 1) of a transfer sheet P, and in the other method, superimposed toner images of four colors on the second intermediary transfer belt 31 are transferred onto the second side (downward faced in FIG. 1) of the transfer sheet P.

When the image information for a plurality of pages is performed on a plurality of transfer sheets P in succession, it is preferable to control the image formation such that the plurality of transfer sheets P, each carrying the image of a corresponding page on one side thereof, are stacked in the order of pages on the discharge/stack part 75. In the former method, because the first side of the transfer sheet P carrying an image is directed upward when the transfer sheet P is stacked in the discharge/stack part 75, when image information for a plurality of pages is performed on the plurality of transfer sheets P in succession, by forming images for the plurality of pages starting with an image for the last page, the plurality of transfer sheets P, each carrying the image of a corresponding page, are stacked in order of pages on the discharge/stack part 75, that is, the transfer sheet P carrying the image for the first page on one side thereof is on the top with the side carrying the image faced upward and the transfer sheet P carrying the image for the last page on one side thereof is on the bottom with the side carrying the image upward faced. Therefore, the description will be made with respect to the former method.

When the printer part 100 is started to operate by receiving a print information signal described later, the first intermediary transfer belt 21 and the first photoconductors 1Y, 1C, 1M, and 1K of the first process units 80Y, 80C, 80M, and 80K rotate. At the same time, the second intermediary transfer belt 31 is moved. However, the second photoconductors 6Y, 6C, 6M, and 6K of the second process units 81Y, 81C, 81M, and 81K are separated from the second intermediary transfer belt 31 and are not rotated. Then, an image formation with the first process unit 80Y is started. Light corresponding to image data for yellow, emitted by the LED (light emitting diode) of the optical writing device 4, illuminates the surface of the first photoconductor 1Y uniformly charged by the charge device 3, and thereby an electrostatic latent image for yellow is formed on the first photoconductor 1Y.

The electrostatic latent image is developed into a yellow toner image by the development device 5 of the first process unit 80Y for yellow, and the image is electrostatically transferred onto the first intermediary transfer belt 21 at the first transfer nip for yellow. The above-described formation of the electrostatic latent image, development of the electrostatic latent image into a toner image, and transfer of the toner image onto the first intermediary transfer belt 21 are performed for the first photoconductors 1C, 1M, and 1K, sequentially, at appropriate timings, respectively. The first toner images of cyan, magenta, and black are sequentially transferred at respective transfer nips onto the first intermediary transfer belt 21 while being sequentially superimposed on the toner image of yellow. Thereby, the superimposed first toner images of the four colors are formed on the first intermediary transfer belt 21.

On the other hand, the sheet feed device 40 feeds out the transfer sheet P from the large volume sheet feed tray 40*a*, the sheet feed cassettes 40*b*, 40*c* and 40*d* or from the second sheet feed device 300. The transfer sheet P is conveyed through the sheet conveyance path 43B or 43C to the sheet conveyance path 43A of the printer part 100. The transfer sheet P is then conveyed to the lateral registration correction device 44.

The lateral registration mechanism 44 corrects a slanting of the transfer sheet P relative to the conveyance direction of the transfer sheet P by jogging the transfer sheet P with the pair of guide plates at both sides of the transfer sheet P in the conveyance direction of the transfer sheet P.

The transfer sheet P is thereafter fed into the rollers of the registration roller pair 45, and is timed there to be subsequently fed out to the first transfer part (the secondary transfer nip). The superimposed first toner images of the four colors on the first intermediary transfer belt 21 are transferred onto the first side of the transfer sheet P at the first transfer part (the secondary transfer nip). The surface of the first intermediary transfer belt 21 after passing the first transfer part (the secondary transfer nip) is cleaned by the cleaning device 20A to remove the residual toner.

The residual toner remaining on the surfaces of the first photoconductors 1Y, 1C, 1M, and 1K after passing the first transfer nips is removed by respective cleaning devices 2. The removed toner is collected by the collect devices 2*c* of the cleaning devices 2, and is conveyed to the discarded toner accommodation part 87. The electric potential sensors S1 and the image sensors S2 detect the surface potentials of the first photoconductors 1Y, 1C, 1M, and 1K after the process of exposure and the densities of toners adhered to the surfaces of the photoconductors 1Y, 1C, 1M, and 1K after the process of development, and output information, respectively, to the print controller to set and to control the image formation conditions as necessary. Further, residual charges on the surfaces of the photoconductors 1 Y, 1C, 1M, and 1K after the cleaning process are removed with the discharge devices Q so that the first photoconductors 1Y, 1C, 1M, and 1K are initialized.

The transfer sheet P carrying the superimposed first toner images of the four colors on the first side thereof is conveyed to be received on the second intermediary transfer belt 31 of the second transfer unit 30, and thereafter the transfer sheet P is conveyed to the sheet conveyance unit 50. The transfer sheet P is then conveyed from the sheet conveyance unit 50 to the fixing device 60. An electric charge is applied to the transfer sheet P by the separation charger 58 before the transfer sheet P reaches the fixing device 60. Thereby, the transfer sheet P electrostatically adsorbed to the second intermediary transfer belt 31 is easily separated from the second intermediary transfer belt 31.

Toners of respective colors carried on the first side of the transfer sheet P are melted by heat and are thereby mixed with each other, so that a full color image is formed on the transfer sheet P. Because the transfer sheet P carries toner only on one side of the transfer sheet P, as compared when the transfer sheet P carries toner on both sides of the transfer sheet P, less heat energy is needed for fixing. The print controller optimally controls the electric power used by the fixing device 60 according to the type of an image formed on the transfer sheet P.

Even after the fixing process, before a toner image is completely fixed to the transfer sheet P, the toner image may be disturbed or partially dropped off by being caused to rub against a guide member, etc. of the conveyance path. To avoid such a problem, the cooling belt unit pair 70 is provided to cool the transfer sheet P after passing the fixing device 60.

In this method, the order of image formation is set such that transfer sheets P are stacked in the discharge/stack part 75 on top of each other in such order that the transfer sheet P carrying the image for the first page is on the top and the remaining transfer sheets P are sequentially in order in the discharge/stack part 75. The discharge/stack part 75 is configured to move down as the number of the discharged transfer sheets P increases, so that the transfer sheets P are stacked reliably and in an orderly manner. The transfer sheet P after passing the fixing device 60 and the cooling belt unit pair 70 can be conveyed, instead of being stacked in the discharge/stack part 75, to a post-processing apparatus, such as a sorter, a binding apparatus, etc. as described above.

The operation of forming a full color image on one side of the transfer sheet P in the other method is substantially the same as that of the above-described former method except that the first process units 80Y, 80C, 80M, and 80K do not perform image formation and that images for a plurality of pages are formed starting with the image for the first page so that transfer sheets P are stacked in order of pages. Therefore, the description thereof is omitted.

Next, an operation of forming images on both sides of the transfer sheet P is described.

When a print information signal is received by the printer part 100, first toner images of yellow, cyan, magenta, and black are formed on the first photoconductors 1Y, 1C, 1M, and 1K of the first process units 80Y, 80C, 80M, and 80K as described above. The first toner images are transferred at respective first transfer nips onto the first intermediary transfer belt 21 while being superimposed on top of each other. Substantially in parallel with this operation, second toner images of yellow, cyan, magenta, and black are formed on the second photoconductors 6Y, 6C, 6M, and 6K of the second process units 81Y, 81C, 81M, and 81K. The second toner images are transferred at respective first transfer nips onto the second intermediary transfer belt 31 while being superimposed on top of each other.

Thus, the first toner images of the four colors superimposed on top of each other and the second toner images of the four colors superimposed on top of each other are formed on the first intermediary transfer belt 21 and the second intermediary transfer belt 31, respectively.

The space intervals between the second process units 81Y, 81C, 81M, and 81K are smaller than the space intervals between the first process units 80Y, 80C, 80M, and 80K. Thereby, a transfer of the second toner images onto the second intermediary transfer belt 31 in the second transfer unit 30 is ended earlier than a transfer of the first toner images onto the first intermediary transfer belt 21 in the first transfer unit 20.

The superimposed first toner images on the first intermediary transfer belt 21 are transferred onto the first side of the transfer sheet P conveyed from the registration roller pair 45 at the first transfer part (the second transfer nip) in a synchronized timing. Thereafter, the transfer sheet P is conveyed to the second transfer part where the second intermediary transfer belt 31 and the transfer charger 47 face each other via the predetermined gap. The superimposed second toner images on the second intermediary transfer belt 31 are transferred onto the second side of the transfer sheet P at the second transfer part.

The transfer sheet P carrying the superimposed first toner images on the first side and the superimposed second toner images on the second side thereof is then conveyed to the fixing device 60 via the sheet conveyance unit 50. The fixing process by heating and applying pressure is performed at the fixing device 60, so that the superimposed first toner images and the superimposed second toner images on the transfer sheet P are melted and fixed to the transfer sheet P, respectively, and thereby a first full color image and a second full color image are formed on the first side and the second side of the transfer sheet P, respectively. The transfer sheet P then passes through the cooling belt unit pair 70 and the discharge roller pair 71 to be discharged onto the discharge/stack part 75.

When forming images for a plurality of pages on both sides of a plurality of transfer sheets P, the order of image formation is controlled such that when each transfer sheet P is stacked in the discharge/stack part 75, the side of the transfer sheet P carrying the image for a previous page is faced downward. That is, first, an image for the second page is formed on the first side (front side) of a first transfer sheet P and an image for the first page is formed on the second side (backside) of the first transfer sheet P, and the first transfer sheet P is stacked in the discharge/stack part 75 with the second side carrying the image for the first page faced down.

Next, an image for the fourth page is formed on the first side (front side) of a second transfer sheet P and an image for the third page is formed on the second side (backside) of the second transfer sheet P, and the second transfer sheet P is stacked in the discharge/stack part 75 with the second side carrying the image for the third page faced down. Thereby, when the stack of transfer sheets P has been taken out of the discharge/stack part 75, by reversing the stack of transfer sheets P, the stack of transfer sheets P is placed in order of pages, that is, the first page is on the front side of the first transfer sheet P on the top and the second page is on the backside of the first transfer sheet P on the top, and the third page is on the front side of the second transfer sheet P and the fourth page is on the backside of the second transfer sheet P. A control of the order of image formation as noted above and a control of the electric power to the fixing device 60 to be increased more than when forming an image only on one side of a transfer sheet P are performed by the print controller.

The description has been made for the case that a full color image is formed on one side or both sides of the transfer sheet P. However, it is needless to say that a black-and-white image can be formed using only black toner.

For toner for developing a latent image, it is preferable to use the toner having an average roundness of 0.93-1.00. Here, the average roundness is a numerical value obtained by averaging values of the roundness of a predetermined number of toner particles. The roundness is an index representing the degree of concavity and convexity of a particle, and when the particle is a perfect sphere, the value is 1.00. As the degree of concavity and convexity is larger, the value of the roundness is smaller than 1.00. The roundness of a toner particle is obtained by the following formula 1:

$$\text{Roundness } \alpha = L_0/L \quad (1),$$

wherein $L_0$ is a peripheral length of a perfect circle having the same area as the two-dimensional projected image of a particle, and L is a peripheral length of the two-dimensional projected image of the particle.

The average roundness of the toner can be measured in a manner as described below. First, a suspension liquid including toner particles of an object toner is caused to pass through a detect zone of an imaging device on a flat plate, and two-dimensional projected images of the toner particles are optically photographed by a CCD camera. A value is obtained for each two-dimensional projected image of the toner particles by dividing a peripheral length of a perfect circle having the same area as the two-dimensional projected image, and an average value of 10,000 pieces of the obtained value is calculated, which is the average roundness.

A flow-type particle image analysis apparatus FPIA-2100 of SYSMEX CORPORATION (formerly TOA MEDICAL ELECTRONICS KABUSHIKIKAISHA) may be used in measuring the average roundness. When using this apparatus, a detergent, preferably 0.1-0.5 ml of alkyl benzene sulfonate, is added, as a dispersant, into 100-150 ml of water in a container, from which solid impurities have been removed in advance, and further, about 0.1-0.5 g of the object toner is added. Then, the suspension liquid thus obtained is dispersed by an ultrasonic dispersing device for about 1-3 minutes so that the density of dispersed liquid is adjusted to 3000-10000 μl. The suspension liquid thus obtained is put on the above-described apparatus for measurement.

The toner having the average roundness of 0.93-1.00 demonstrates a superior transfer property, because the contact areas between a photoconductor and a toner particle and between toner particles are made small owing to the smoothness of the surface of each toner particle. Further, because each particle does not include an edge on the surface thereof, the stirring torque for stirring the developer in a development device can be made small and the stirring speed can be stabilized.

Thereby, a change in the performance due to the excessive stirring is suppressed and thereby stable images can be formed. Further, because square toner particles do not exist in a dot of a toner image, when the toner image is pressed against a transfer sheet P for transfer, the transfer pressure is uniformly applied to the toner particles in the dot, so that an omission of a part of the toner image in transferring is hardly caused. Furthermore, because the toner particle is not square, the grinding force of the toner particle is relatively small, so that bruising and abrading the surfaces of a photoconductor can be suppressed.

Figure 5:
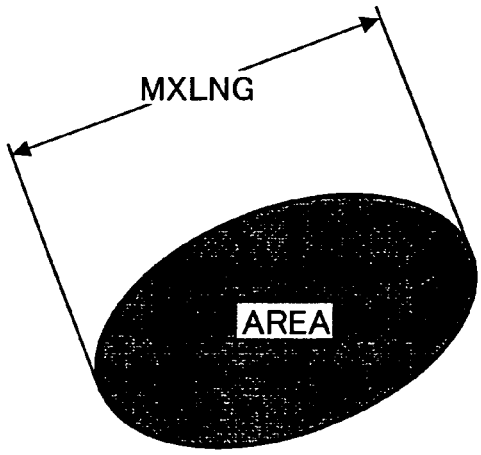
FIG. 5 is a diagram for explaining a method of measuring a shape coefficient SF-1.

Further, it is preferable to use the toner having the shape coefficient SF-1 of 100-180 and the shape coefficient SF-2 of 100-180. The shape coefficient SF-1 and the shape coefficient SF-2 are one of the parameters expressing a shape of toner. The shape coefficient SF-1 is a value expressing the degree of roundness of a substance such as a toner particle. Referring to FIG. 5, the value of SF-1 is obtained by the following formula 2:

$$SF\text{-}1=\{(MXLNG)^2/\mathrm{AREA}\}\times(100\pi/4) \quad (2),$$

wherein MXLNG is the length of the maximum diameter of an elliptical figure obtained by projecting the substance on a two-dimensional flat surface, AREA is the area of the elliptical figure, and π is the ratio of the circumference of a circle to its diameter.

A substance having the SF-1 value of 100 is a perfect sphere, and as the value of SF-1 is greater, the shape of the substance is more irregular.

Figure 6:
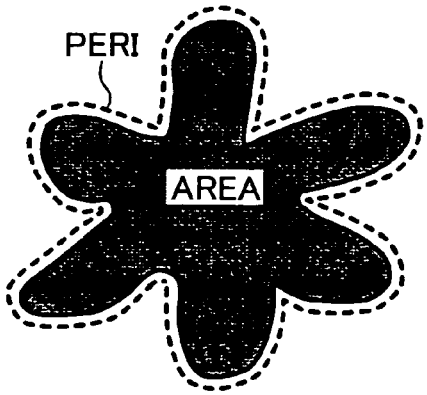
FIG. 6 is a diagram for explaining a method of measuring a shape coefficient SF-2.

The shape coefficient SF-2 is a numerical value expressing the degree of concavity and convexity on a surface of a substance. Referring to FIG. 6, the value of the SF-2 is obtained by the following formula 3:

$$SF\text{-}2=\{(PERI)^2/\mathrm{AREA}\}\times(100\pi/4), \quad (3)$$

wherein PERI is the peripheral length of a figure obtained by projecting the substance on a two-dimensional flat surface. The substance having the SF-2 value of 100 has no concavity and convexity on its surface. As the value of SF-2 is greater, the concavity and convexity on its surface is increased.

It has been found by the work of the present inventors that as the shape of the toner particles is closer to a perfect sphere (the values of SF-1 and SF-2 are closer to 100), the transfer efficiency of the toner is increased. It is believed that because the contact area between the toner particles and that between toner particles and a photoconductor are smaller as the shape of the toner is closer to a perfect sphere, the mobility of the toner is increased and the adsorption force relative to a substance is decreased and thereby the toner is more easily affected by the transfer electric field.

Further, according to the work by the present inventors, when the values of SF-1 and SF-2 of the toner exceed 180, respectively, the transfer efficiency of the toner greatly decreases. When the values of SF-1 and SF-2 of the toner are 180 or smaller, an image having good quality and having no scattering of transferred toner can be formed.

The values of SF-1 and SF-2 may be obtained as average values for 100 pieces of toner particles. The average values of SF-1 and SF-2 may be obtained by photographing 100 pieces of toner particles selected at random with a photographing apparatus FE-SEM (S-800) of HITACHI LTD., obtaining the values of the above-described MXLING, AREA and PERI by analyzing the obtained image information with an image analysis apparatus LUSEX3 of NIRECO CORPORATION, obtaining the values of SF-1 and SF-2 according to the above-described formulas 2 and 3, and averaging the obtained values.

It is preferable to use the toner whose weight average particle diameter Dm is 3-8 μm and whose value of Dm/Dn is 1.00-1.40, wherein Dn is the quantity average particle diameter. The toner with the above values for Dm and Dm/Dn has such an advantage that when reproducing dots at the resolution equal to or greater than 600 dpi, a superior dot reproduction is realized by causing sufficiently small toner particles to be adhered to the latent images of the dots on the photoconductor. When the weight average particle diameter Dm is smaller than 3 μm, the transfer efficiency and the cleaning property rapidly decrease. When the weight average particle diameter exceeds 8 μm, the scattering of the toner around a character image and a line image rapidly increases.

The value of Dm/Dn indicates the sharpness of the inclination in the particle diameter distribution of the toner particles in the toner. As the Dm/Dn value is closer to 100, the breadth of the particle diameter distribution is narrower, and the distribution of the charge amounts of the toner particles becomes uniform, so that an image of high quality hardly having background soiling can be obtained. Further, the electrostatic transfer efficiency is increased.

The particle diameter distribution can be measured with a measurement apparatus using a Coulter counter method, such as Coulter counter TA-II and Coulter multi-sizer II of COULTER, INC. Specifically, first, a detergent (preferably, alkyl benzene sulfonate) of 0.1-5 ml is added as a dispersant to an electrolytic aqueous solution. A NaCl aqueous solution in which Class I natrium chloride has been dispersed about 1%, e.g., ISOTON-II of COULTER, INC., may be used for the electrolytic aqueous solution. A measurement sample of 2-20 mg is added to the solution, and the solution is dispersed for 1-3 minutes with an ultrasonic disperser.

The weight and the number of toner particles are measured with the above-described apparatuses using an aperture of 100 μm, and then the weight distribution and the quantity distribution thereof are calculated. The weight average particle diameter Dm and the quantity average particle diameter Dn of the toner are obtained based on the calculated weight distribution and the quantity distribution. The target toner particles are those having the particle diameter of 2.00 μm and above and below 40.30 μm, and 13 conduits with the following diameters are used: 2.00 μm and above and below 2.52 μm, 2.52 μm and above and below 3.17 μm, 3.17 μm and above and below 4.00 μm, 4.00 μm and above and below 5.04 μm, 5.04 μm and above and below 6.35 μm, 6.35 μm and above and below 8.00 μm, 8.00 μm and above and below 10.08 μm, 10.08 μm and above and below 12.70 μm, 12.70 μm and above and below 16.00 μm, 16.00 μm and above and below 20.20 μm, 20.20 μm and above and below 25.40 μm, 25.40 μm and above and below 32.00 μm, and 32.00 μm and above and below 40.30 μm. The values of Dm and Dn are obtained as the averages for 10,000 pieces of toner particles.

In the copying machine with the above-described configuration, writing first latent images on a plurality of first latent image bearing members is achieved by the optical writing devices 4 of the first process units 80Y, 80C, 80M, and 80K. Further, writing second latent images on a plurality of second latent image bearing members is achieved by the optical writing devices 4 of the second process units 81Y, 81C, 81M, and 81K. Further, transferring first visible images on the first latent image bearing members onto the first side of a transfer sheet P and second visible images on the second latent image bearing members onto the second side of the transfer sheet P is achieved by the combination of the first transfer unit 20 and the second transfer unit 30. Still further, the registration roller pair 45 functions as the feed device of the present invention, feeding the transfer sheet P to the both-sides transfer device.

Figure 7:
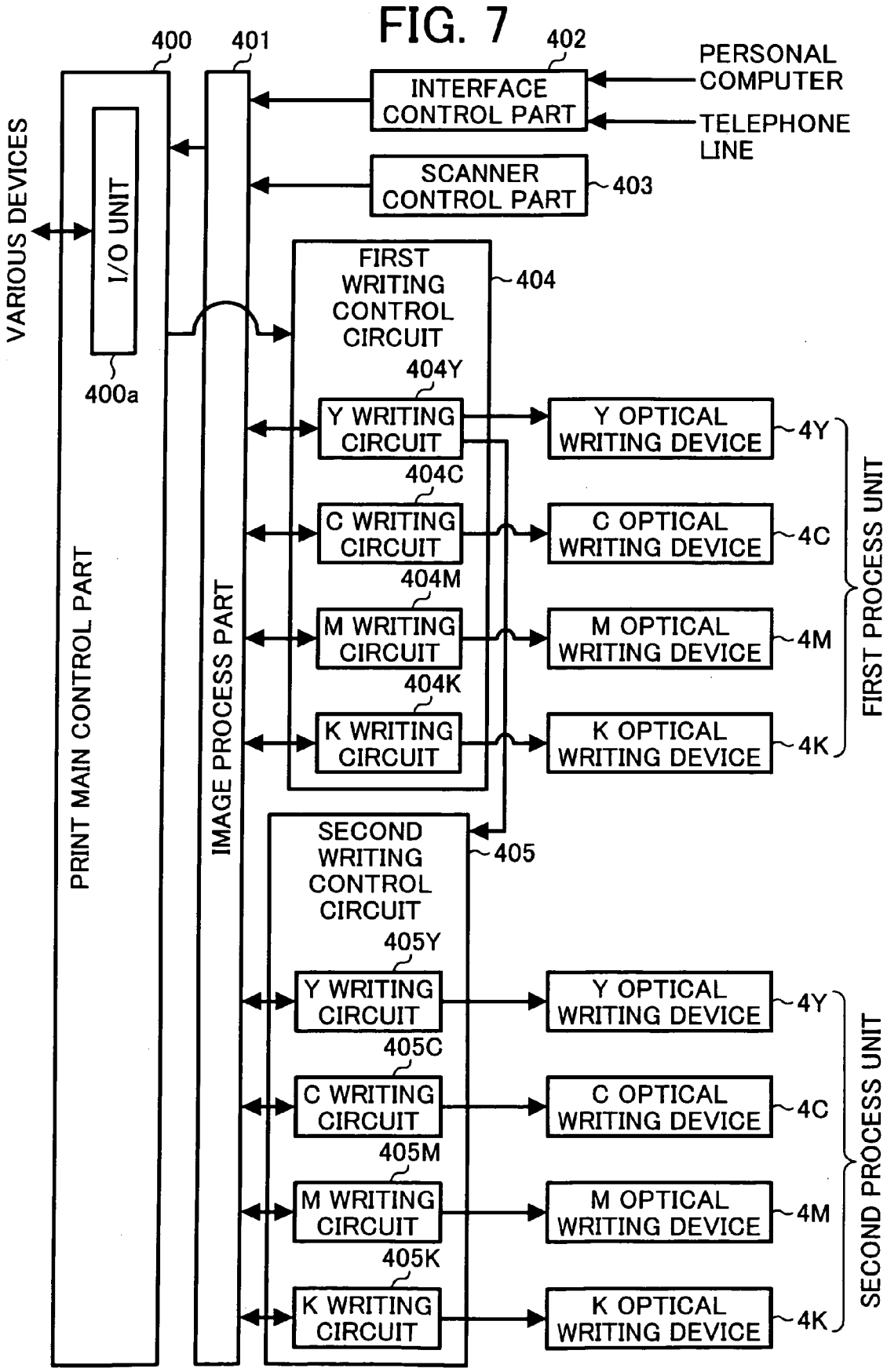
FIG. 7 is a block diagram illustrating a part of an electric circuit of the copying machine.

FIG. 7 is a block diagram illustrating a part of an electrical circuit of the copying machine. The copying machine includes a print main control part 400, an image process part 401, an interface control part 402, a scanner control part 403, a first writing control circuit 404, and a second writing control circuit 405.

The print main control part 400 includes an I/O unit 400*a*, a RAM (not shown), a ROM (not shown), and a CPU (not shown), and is configured to perform control of the entire part of the printer part 100 according to a control program stored in the ROM. Various devices are connected to the I/O unit 400*a* and are controlled by the print main control part 400. For example, drive motors driving the photoconductors and the intermediary transfer belts, a registration clutch turning on and off the drive force to the registration roller pair 45, drive devices driving the sheet replenishment device 300, the fixing device 60, various power sources, etc. are connected to the I/O unit 400*a*. Various sensors transmitting signals to the print main control part 400, such as the toner density sensor 5*e*, a feed sensor, a fixing part discharge sensor, a toner end sensor, a registration sensor, etc., are also connected to the I/O unit 400*a*.

The interface control part 402 is configured to receive image information transmitted from a personal computer and a telephone line and to transmit the image information to the image process part 401. Thus, due to the interface control part 402, the copying machine has a printer function and a facsimile outputting function, in addition to the copying function of reading an original document with the automatic original document feed/read device 200.

The scanner control part 403 controls reading an original document with the automatic original document feed/read device 200 and transmits image information obtained by reading the original document to the image process part 401.

The image process part 401 receives image information including print information relating to the print condition for the image information, such as the size of a sheet to be used, the image formation mode, such as a single-side mode and a both-sides mode, etc., transmitted from the interface control part 402 and the scanner control part 403, and transmits a print information signal to the print main control part 400. Further, the image process part 401 generates latent image writing information signals based on the received image information, and transmits the latent image writing information signals to the first writing control circuit 404 and the second writing control circuit 405 as described later.

The print main control part 400 controls various devices of the printer part 100 based on the print information transmitted from the image process part 401 and the control program described above. The print main control part 400 determines a job start time as a criterion timing in a series of image forming operations, and based on the job start time drives the devices of the printer part 100, for example to start and stop. Further, the print main control part 400 transmits the job start signal to the first writing control circuit 404 at the job start time.

The first writing control circuit 404 according to one embodiment of the present invention controls a writing of the first latent images for yellow, cyan, magenta, and black with a yellow (Y) optical writing device 4Y, a cyan (C) optical writing device 4C, a magenta (M) optical writing device 4M, and a black (K) optical writing device 4K of the first process units 80Y, 80C, 80M, and 80K. The first writing control circuit 404 is provided separately from the print main control part 400 to perform another control in parallel with the control performed by the print main control part 400. Specifically, the first writing control circuit 404 is configured by an ASIC (application specific integrated circuit) dedicated to controlling the writing of first latent images by the optical writing devices of the first process units.

The first writing control circuit 404 includes four first independent control parts respectively configured to perform controls independently. Specifically, a yellow (Y) writing circuit 404Y, a cyan (C) writing circuit 404C, a magenta (M) writing circuit 404M, and a black (K) writing circuit 404K are provided for controlling the writing of the first latent images for yellow, cyan, magenta, and black. These writing circuits start respective writing processes at appropriate timings and control the corresponding optical writing devices.

In the writing processes, first, information request signals for requesting latent image writing information signals are transmitted to the image process part 401. The image process part 401 having received the information request signals transmits latent image writing information signals corresponding to the information request signals to the yellow writing circuit 404Y, the cyan writing circuit 404C, the magenta writing circuit 404M, and the black writing circuit 404K. The yellow writing circuit 404Y, the cyan writing circuit 404C, the magenta writing circuit 404M, and the black writing circuit 404K control the yellow optical writing device 4Y, the cyan optical writing device 4C, the magenta optical writing device 4M, and the black optical writing device 4K (of the first process units) based on the latent image writing information signals transmitted thereto, respectively.

The second writing control circuit 405 as a second writing control device according to one embodiment of the present invention controls the writing of the second latent images for yellow, cyan, magenta, and black with a yellow (Y) optical writing device 4Y, a cyan (C) optical writing device 4C, a magenta (M) optical writing device 4M, and a black (K) optical writing device 4K of the second process units 81Y, 81C, 81M, and 81K. The second writing control circuit 405 is provided separately from the print main control part 400 and the first writing control circuit 404 to perform another control, in parallel with the controls performed by the print main control part 400 and the first writing control circuit 404. Specifically, the second writing control circuit 405 is configured by an ASIC dedicated to controlling the writing of the second latent images by the optical writing devices of the second process units.

The second writing control circuit 405 includes four second independent control parts respectively configured to perform controls independently. Specifically, a yellow (Y) writing circuit 405Y, a cyan (C) writing circuit 405C, a magenta (M) writing circuit 405M, and a black (K) writing circuit 405K are provided for controlling the writing of the second latent images for yellow, cyan, magenta, and black. These writing circuits start respective writing processes at appropriate timings and control the corresponding optical writing devices.

In the writing processes, first, information request signals for requesting latent image writing information signals are transmitted to the image process part 401. The image process part 401 having received the information request signals transmits the latent image writing information signals corresponding to the information request signals to the yellow writing circuit 405Y, the cyan writing circuit 405C, the magenta writing circuit 405M, and the black writing circuit 405K.

The yellow writing circuit 405Y, the cyan writing circuit 405C, the magenta writing circuit 405M, and the black writing circuit 405K control the yellow optical writing device 4Y, the cyan optical writing device 4C, the magenta optical writing device 4M, and the black optical writing device 4K (of the second process units) based on the latent image writing information signals transmitted thereto, respectively.

Figure 8:
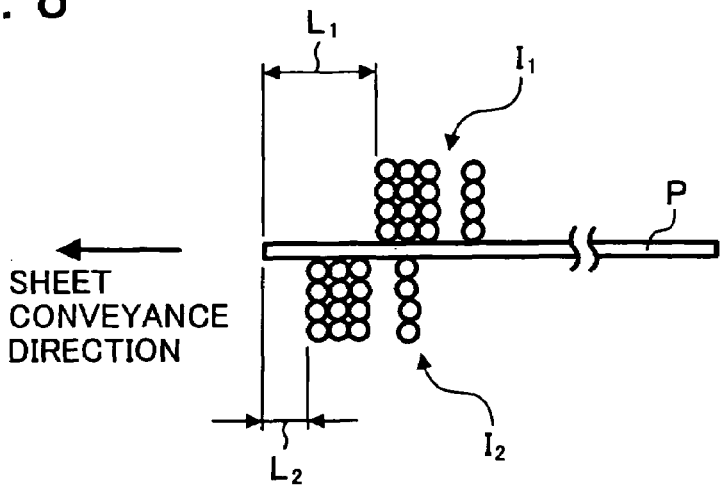
FIG. 8 is a diagram illustrating a first toner image and a second toner image formed on the first side and the second side of a transfer sheet, respectively.

In image forming apparatuses forming images on both sides of a recording medium such as a transfer sheet using separate latent image bearing members for forming an image on one side of the recording medium and for forming an image on the other side of the recording medium as in the above-described copying machine, there is the possibility that a deviation is caused in the positions of the images formed on the first side and the second side of the recording medium in the conveyance direction of the recording medium, as illustrated in FIG. 8.

In FIG. 8, the tip end of a first full color image 11 formed on the first side (upper side in figure) of the transfer sheet P in the conveyance direction of the transfer sheet P is positioned at the position separated from the tip end of the transfer sheet P by the distance $L_1$ along the conveyance direction.

On the other hand, the tip end of a second full color image 12 formed on the second side (backside) of the transfer sheet P is positioned at the position separated from the tip end of the transfer sheet P by the distance $L_2$ along the conveyance direction. Here, the distance $L_1$ is greater than the distance $L_2$. That is, the positions of the first full color image $I_1$ and the second full color image $I_2$ are deviated from each other by the length corresponding to $L_1$-$L_2$ along the conveyance direction. This makes conspicuous a deviation in the positions of character lines in the images on the first and second sides of the transfer sheet P.

Figure 9:
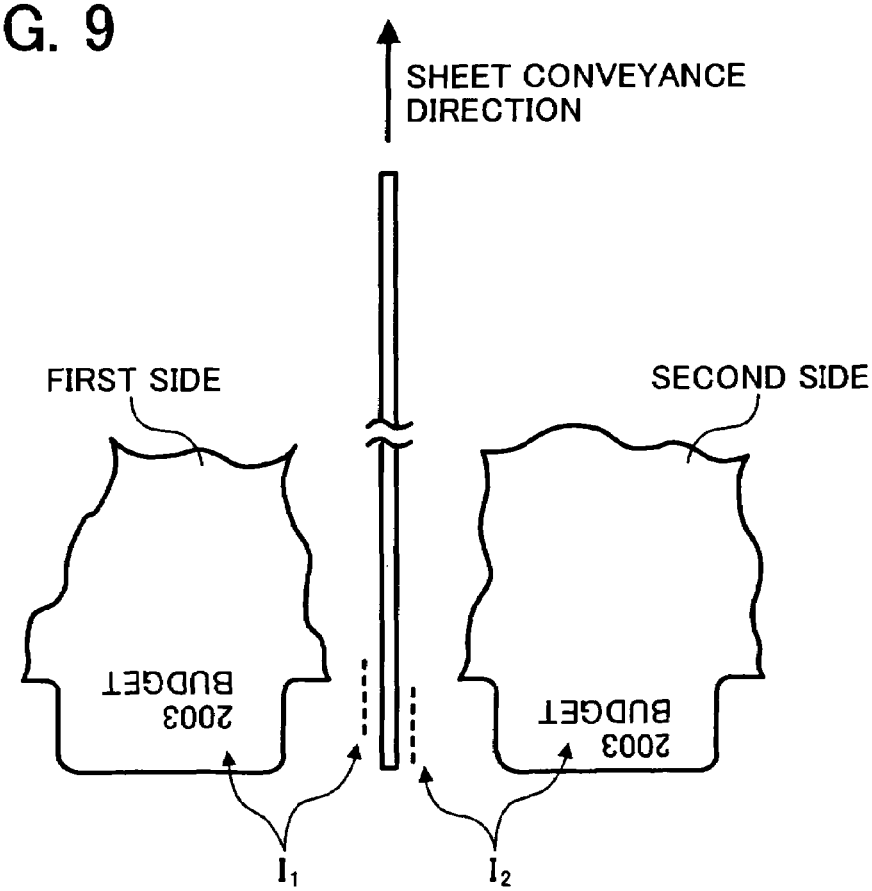
FIG. 9 is a diagram illustrating a first toner image and a second toner image formed on the first side and the second side of a tab part of a transfer sheet, respectively.

For example, as illustrated in FIG. 9, when a transfer sheet P having a tab portion is used and character images are formed on both sides of the tab portion of the transfer sheet P, a deviation in the positions of the character images formed on both sides of the tab portion of the transfer sheet P is conspicuous.

In the copying machine according to one embodiment of the present invention, therefore, such a positional deviation in the images formed on both sides of the transfer sheet P is suppressed by configuring each writing circuit of the first writing control circuit 404 and the second writing control circuit 405 to transmit the above-described information request signal not only to the image process part 401 but also to the print main control part 400 to inform the print main control part 400 of starting a writing process. Further, the yellow writing circuit 404Y of the first writing control circuit 404 is configured to transmit the information request signal to the second writing control circuit 405 to inform the second writing control circuit 405 of starting a writing process by the yellow writing circuit 404Y.

Figure 10:
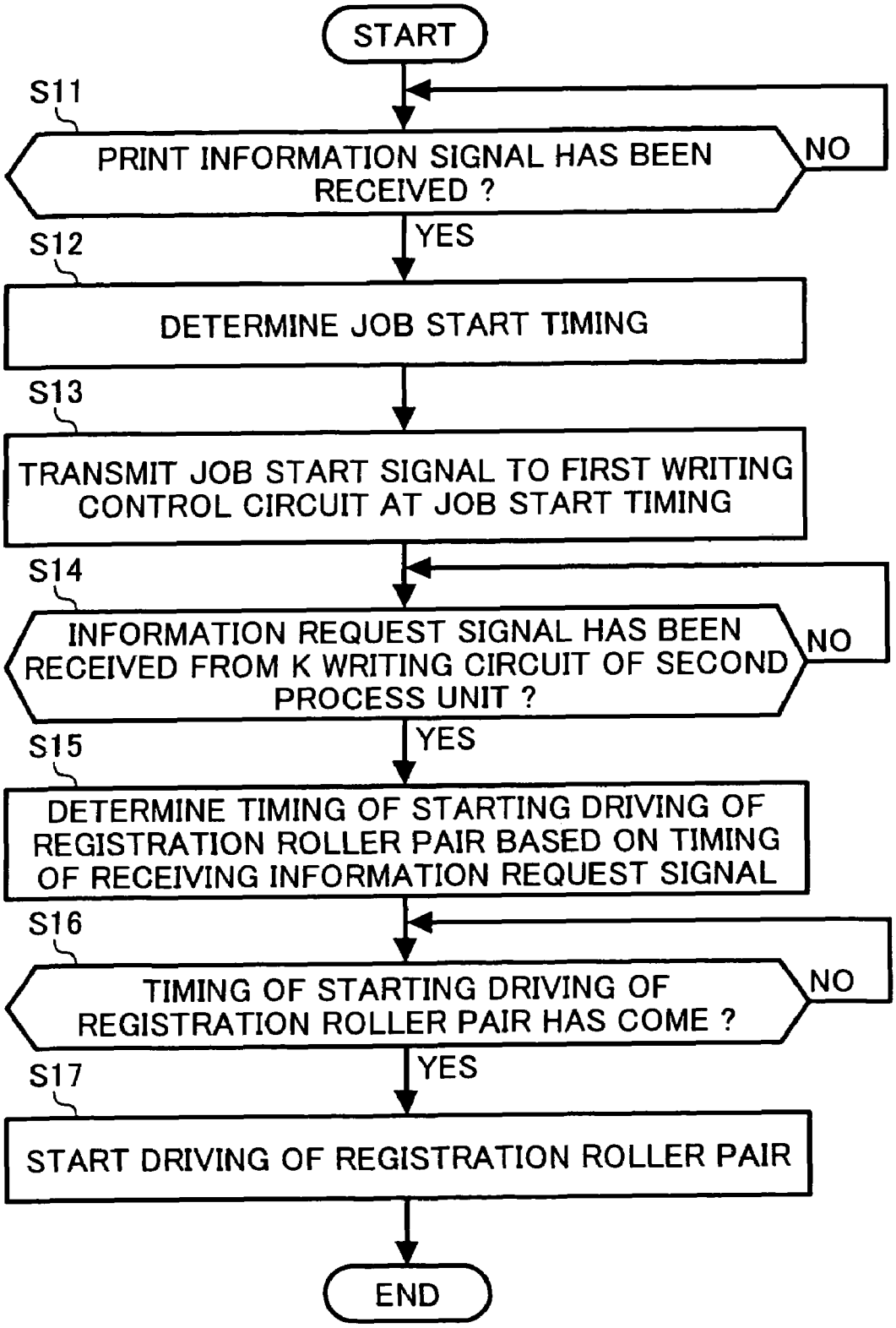
FIG. 10 is a flowchart illustrating a part of a control flow performed by the print main control part of the copying machine.

FIG. 10 is a flowchart illustrating a part of a control flow performed by the print main control part 400. The print main control part 400 determines whether a print information signal relating to image information, obtained with the automatic original document feed/read device 200 or received from a PC or a network, has been received from the image process part 401 in step 11 (hereinafter step is abbreviated to "S"). When a print information signal has been received, the print main control part 400 determines the job start time, which serves as the criterion timing, based on the received print information signal (S12). Then, a job start signal is transmitted to the first writing control circuit 404 at the job start time (S13).

Subsequently, the print main control part 400 waits to receive an information request signal to be transmitted from the black writing circuit 405K of the second writing control circuit 405, that is, the main print control part 400 waits for receiving the timing for starting a writing process of the black writing circuit 405K (S14). When the information request signal has been received in S14, the timing for starting driving the registration roller pair 45, i.e., the timing for starting feeding a transfer sheet P, is determined based on the timing for receiving the information request signal (S15), and driving of the registration roller pair 45 is started at the determined timing (S16, S17).

In the flowchart of FIG. 10, the timing for starting driving the registration roller pair 45 may be determined based on an information request signal to be transmitted from either another writing circuit of the second writing control circuit 405 or the first writing control circuit 404 instead of the information request signal transmitted from the black writing circuit 405K of the second writing control circuit 405.

Further, the flowchart illustrates a case in which the formation of an image on one side of the transfer sheet P (i.e., the single-side mode) is performed using the second process units. When performing the formation of the image on one side of the transfer sheet P using the first process units, in S14, the print main control part 400 waits for an information request signal to be transmitted from the black writing circuit 404K of the first writing control circuit 404 instead of the information request signal from the black writing circuit 405K of the second writing control circuit 405.

Figure 11:
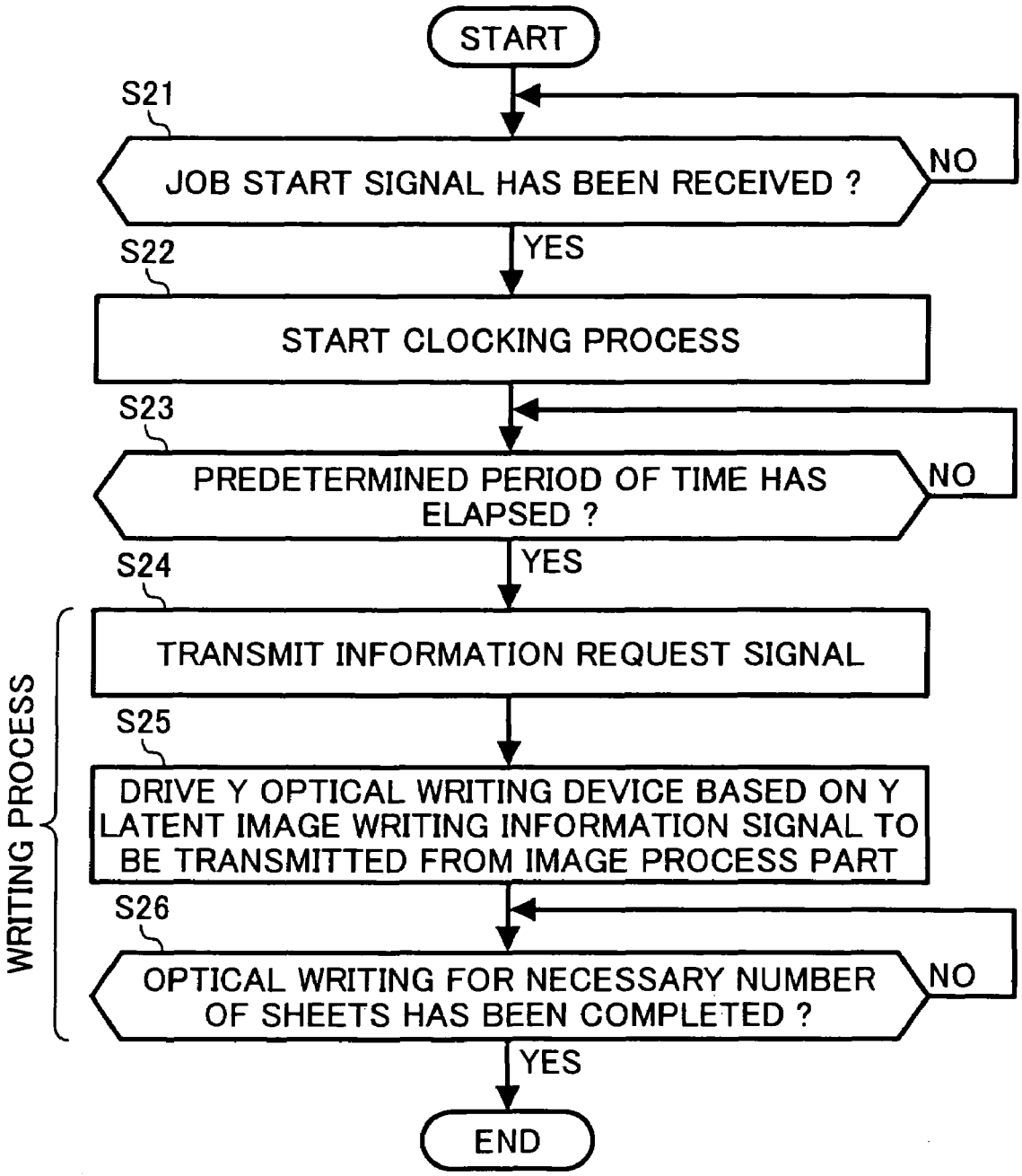
FIG. 11 is a flowchart illustrating the main part of a control flow performed by a yellow writing circuit of a first writing control circuit of the copying machine.

FIG. 11 is a flowchart illustrating the main part of a control flow performed by the yellow writing circuit 404Y of the first writing control circuit 404. The yellow writing circuit 404Y waits for the job start signal transmitted from the print main control part 400 to be received by the first writing control circuit 404 (S21). When the job start signal has been received, a clocking process is started (S22). It is then determined whether a predetermined period of time has elapsed (S23) since the job start signal has been received. The predetermined period of time corresponds to a time lag between a time when the job start time has arrived and a time when a writing of a first latent image for yellow starts at an appropriate timing.

When it has been determined in S23 that the predetermined period of time has elapsed, the yellow writing circuit 404Y starts a writing process. In the writing process, first an information request signal is transmitted to the image process part 401 and to the second writing control circuit 405 (S24). Then, the yellow optical writing device 4Y of the first process unit 80Y is driven based on a yellow latent image writing information signal to be transmitted from the image process part 401 based on the information request signal, and thereby the optical writing of the first latent image for yellow is started (S25). Subsequently, it is determined whether the optical writing for the necessary number of sheets has been completed (S26), and when the optical writing has been completed, the writing process ends and the control process ends.

Figure 12:
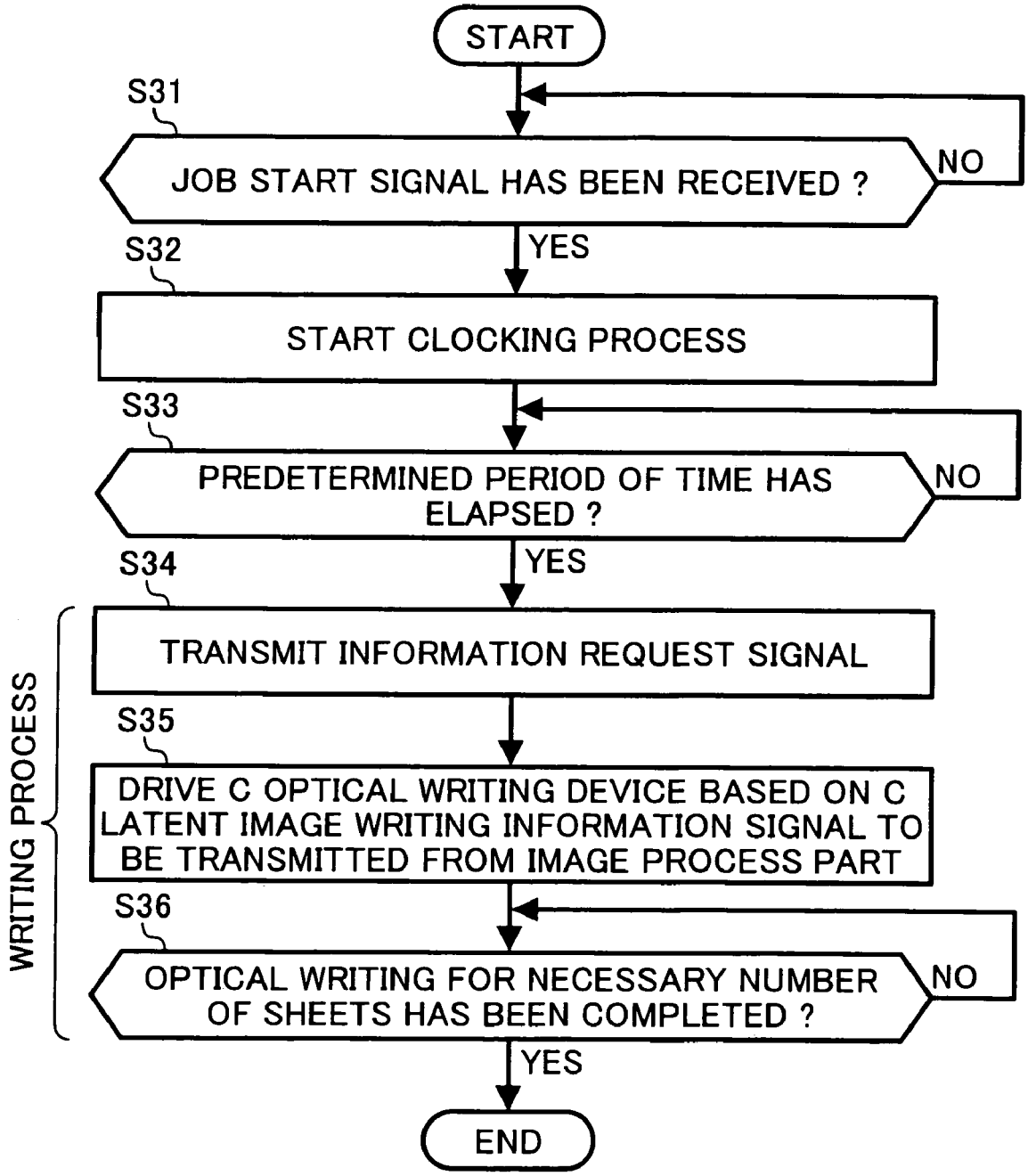
FIG. 12 is a flowchart illustrating the main part of a control flow performed by a cyan writing circuit of the first writing control circuit of the copying machine.

FIG. 12 is a flowchart illustrating the main part of a control flow performed by the cyan writing circuit 404C of the first writing control circuit 404. The cyan writing circuit 404C waits for the job start signal transmitted from the print main control part 400 to be received by the first writing control circuit 404 (S31). When the job start signal has been received, a clocking process is started (S32). It is then determined whether a predetermined period of time has elapsed (S33). The predetermined period of time corresponds to a time lag between a time when the job start time has come and a time when a writing of a first latent image for cyan starts at an appropriate timing. When it has been determined in S33 that the predetermined period of time has elapsed, the cyan writing circuit 404C starts the writing process.

In the writing process, first an information request signal is transmitted to the image process part 401 (S34). Then, the cyan optical writing device 4C of the first process unit 80C is driven based on a cyan latent image writing information signal to be transmitted from the image process part 401 based on the information request signal, and thereby an optical writing of the first latent image for cyan is started (S35). Subsequently, it is determined whether the optical writing for the necessary number of sheets has been completed (S36), and when the optical writing has been completed, the writing process ends and the control process ends.

The control flows performed by the magenta writing circuit 404M and the black writing circuit 404K of the first writing control circuit 404 are similar to the control flow of FIG. 12. The description thereof is therefore omitted. However, the lengths of the predetermined period of time in S33 can be different from the one for the cyan writing circuit 404C in FIG. 12 or may be the same.

In the above-described example, the yellow writing circuit 404Y, the cyan writing circuit 404C, the magenta writing circuit 404M, and the back writing circuit 404K are configured to determine the timings for starting the writing processes by clocking processes based on a receipt of the job start signal. However, each of or at least one of the cyan writing circuit 404C, the magenta writing circuit 404M, and the black writing circuit 404K of the first writing control circuit 404 may be configured to determine the timing for starting the writing process by the clocking process based on, instead of the receipt of the job start signal, an information request signal (i.e., the timing for starting a writing process) from a writing circuit of the first writing control circuit 404, that starts a writing process thereof before each of or at least one of the cyan writing circuit 404C, the magenta writing circuit 404M, and the black writing circuit 404K.

For example, the cyan writing circuit 404C determines the timing for starting the writing process thereof based on the timing for starting the writing process of the yellow writing circuit 404Y, and the magenta writing circuit 404M determines the timing for starting the writing process thereof based on the timing for starting the writing process of the yellow writing circuit 404Y or that of the cyan writing circuit 404C. Similarly, the black writing circuit 404K determines the timing for starting the writing process thereof based on the timing for starting the writing process of the yellow writing circuit 404Y, that of the cyan writing circuit 404C, or that of the magenta writing circuit 404M.

Figure 13:
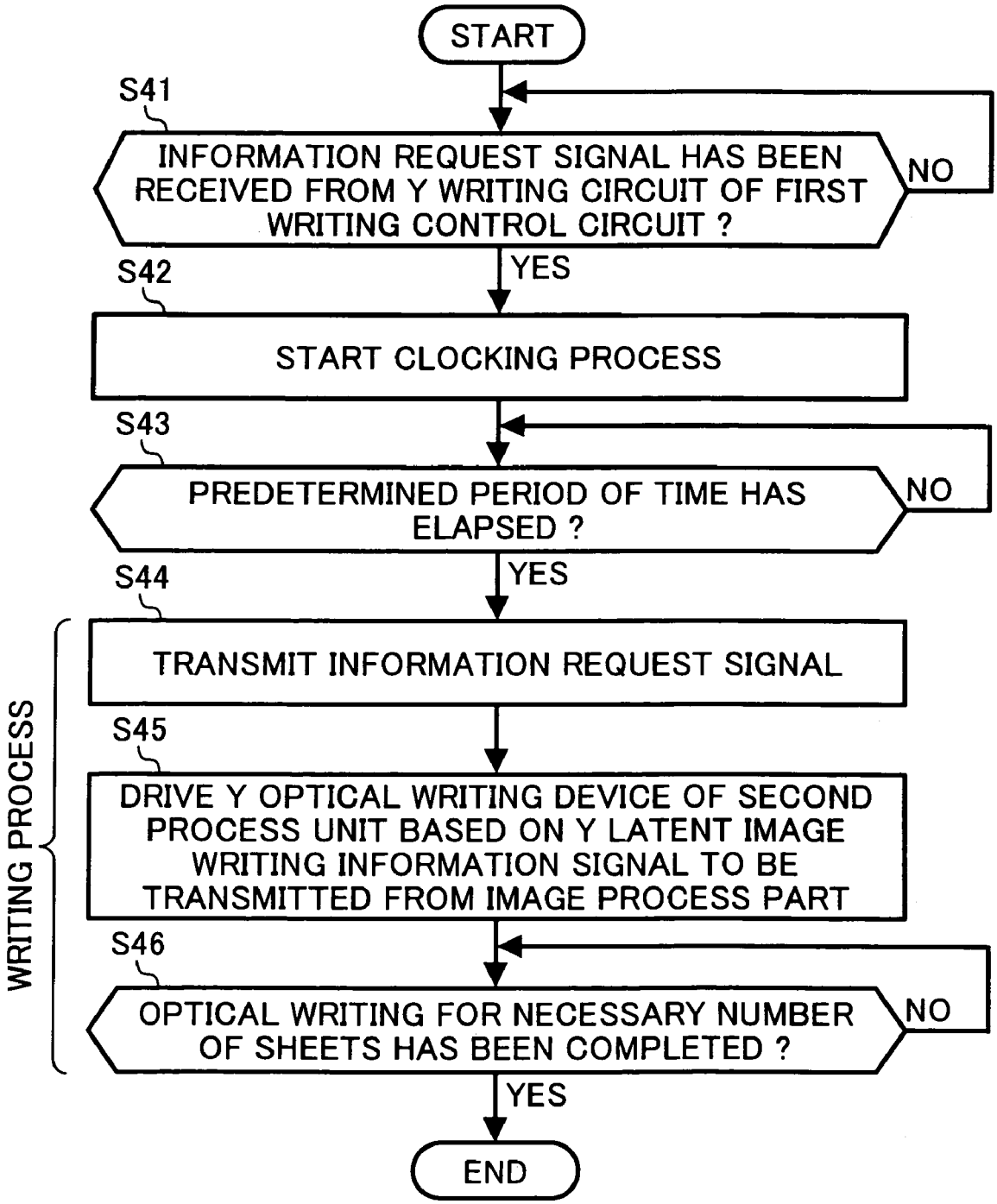
FIG. 13 is a flowchart illustrating the main part of a control flow performed by a yellow writing circuit of a second writing control circuit of the copying machine.

FIG. 13 is a flowchart illustrating the main part of a control flow performed by the yellow writing circuit 405Y of the second writing control circuit 405. The yellow writing circuit 405Y first waits for the information request signal transmitted from the yellow writing circuit 404Y of the first writing control circuit 404 to be received by the second writing control circuit 405 (S41). That is, the yellow writing circuit 405Y waits for the timing for starting a writing process of the yellow writing circuit 404Y. When the information request signal has been received, a clocking process is started (S42).

It is then determined whether a predetermined period of time has elapsed (S43). The predetermined period of time corresponds to a time lag between a time when the yellow writing circuit 404Y of the first writing control circuit 404 has started the writing process and a time when a writing of a second latent image for yellow starts at an appropriate timing. When it has been determined in S43 that the predetermined period of time has elapsed, the yellow writing circuit 405Y starts the writing process.

In the writing process, first an information request signal is transmitted to the image process part 401 (S44). Then, the yellow optical writing device 4Y of the second process unit 81Y is driven based on a yellow latent image writing information signal to be transmitted from the image process part 401 based on the information request signal, and thereby an optical writing of the second latent image for yellow is started (S45). Subsequently, it is determined whether the optical writing for the necessary number of sheets has been completed (S46), and when the optical writing has been completed, the writing process ends and the control process ends.

In the above-described example, the yellow writing circuit 405Y of the second writing control circuit 405 is configured to determine the timing for starting the writing process thereof based on the timing for starting the writing process of the yellow writing circuit 404Y of the first writing control circuit 404. However, the yellow writing circuit 405Y of the second writing control circuit 405 may be configured to determine the timing for starting the writing process thereof based on, instead of the timing for starting the writing process of the yellow writing circuit 404Y of the first writing control circuit 404, the timing for starting the writing process of the cyan writing circuit 404C or the magenta writing circuit 404M of the first writing control circuit 404.

According to one embodiment of the present invention, the timing for starting the writing process of the yellow writing circuit 405Y of the second writing control circuit 405 cannot be determined based on the timing for starting the writing process of the black writing circuit 404K of the first writing control circuit 404. This is because the length of the second intermediary transfer belt 31 from the first transfer nip for yellow to the second transfer part at the side of the second process unit is greater than the length of the first intermediary transfer belt 21 from the first transfer nip for black to the second transfer nip at the side of the first process unit. Thus, the timing for starting the writing process of the yellow writing circuit 405Y of the second writing control circuit 405 is prior to the timing for starting the writing process of the black writing circuit 404K of the first writing control circuit 404.

The control flows performed by the cyan writing circuit 405C, the magenta writing circuit 405M, and the black writing circuit 405K of the second writing control circuit 405 are similar to the one of FIG. 13. Therefore, the description thereof is omitted. Each length of the predetermined period of time in S43 is different from or the same as the yellow writing circuit 405Y.

The cyan writing circuit 405C, the magenta writing circuit 405M, and the black writing circuit 405K of the second writing control circuit 405 may be configured to determine the timings for starting respective writing processes based on any of the timings for starting the writing processes of the cyan writing circuit 404C, the magenta writing circuit 404M, and the black writing circuit 404K of the first writing control circuit 404.

In the above-described example, the cyan writing circuit 405C, the magenta writing circuit 405M, and the black writing circuit 405K of the second writing control circuit 405 are configured to determine the timings for starting respective writing processes by clocking processes based on receipt of the information request signal from the first writing control circuit 404. However, each of or at least one of the cyan writing circuit 405C, the magenta writing circuit 405M, and the black writing circuit 405K of the second writing control circuit 405 may be configured to determine the timing for starting the writing process thereof by the clocking process based on, instead of the information request signal from the first writing control circuit 404, the information request signal (i.e., the timing of a starting a writing process) from a writing circuit of the second writing control circuit 405, that starts a writing process thereof before the each of or at least one of the cyan writing circuit 405C, the magenta writing circuit 405M, and the black writing circuit 405K.

For example, the cyan writing circuit 405C determines the timing for starting the writing process thereof based on the timing for starting the writing process of the yellow writing circuit 405Y, and the magenta writing circuit 405M determines the timing for starting the writing process thereof based on the timing for starting the writing process of the yellow writing circuit 405Y or the cyan writing circuit 405C. Similarly, the black writing circuit 405K determines the timing for starting the writing process thereof based on the timing for starting the writing process of the yellow writing circuit 405Y, the cyan writing circuit 405C, or the magenta writing circuit 405M.

In the above-described example, the yellow writing circuit 404Y of the first writing control circuit 404 is configured to start the writing process thereof based on the job start signal. However, the yellow writing circuit 404Y may be configured to determine the timing of starting the writing process thereof based on, instead of the job start signal as described above, a writing instruction signal to be transmitted from the print main control part 400.

That is, the print main control part 400 is configured to clock the timing for starting a writing process of the yellow writing circuit 404Y and to transmit a writing instruction signal to the yellow writing circuit 404Y based on the clocked timing, and the yellow writing circuit 404Y determines the timing for starting the writing process thereof based on the received writing instruction signal. The other writing circuits of the first writing control circuit 404 may be configured to determine the timings for starting respective writing processes based on the signal of the writing instruction transmitted from the print main control part 400 to the yellow writing circuit 404Y.

Figure 14:
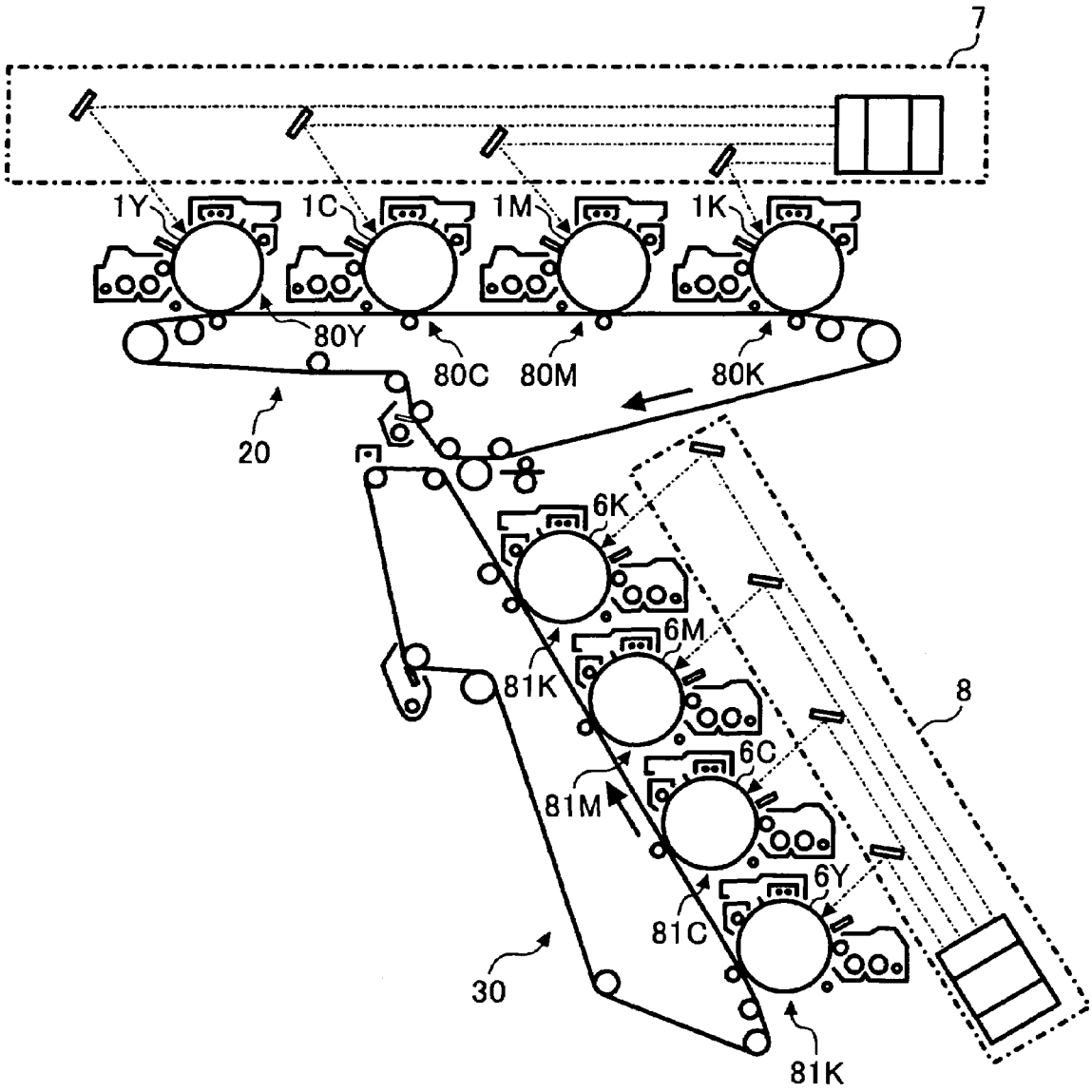
FIG. 14 is a diagram illustrating a part of the printer part of the copying machine according to another embodiment of the present invention.

FIG. 14 is a diagram illustrating according to another embodiment a part of the printer part 100 having another configuration. In this example, instead of providing an optical writing device to each of the first process units 80Y, 80C, 80M, and 80K, a first optical writing device 7 is provided to be shared by the first process units 80Y, 80C, 80M, and 80K. The first optical writing device 7 employs a laser writing method using laser emitting devices for yellow, cyan, magenta, and black, a plurality of reflecting mirrors, a polygon mirror, and a polygon motor. Similarly, a second optical writing device 8 is provided to be shared by the second process units 81Y, 81C, 81M, and 81K.

Figure 15A:
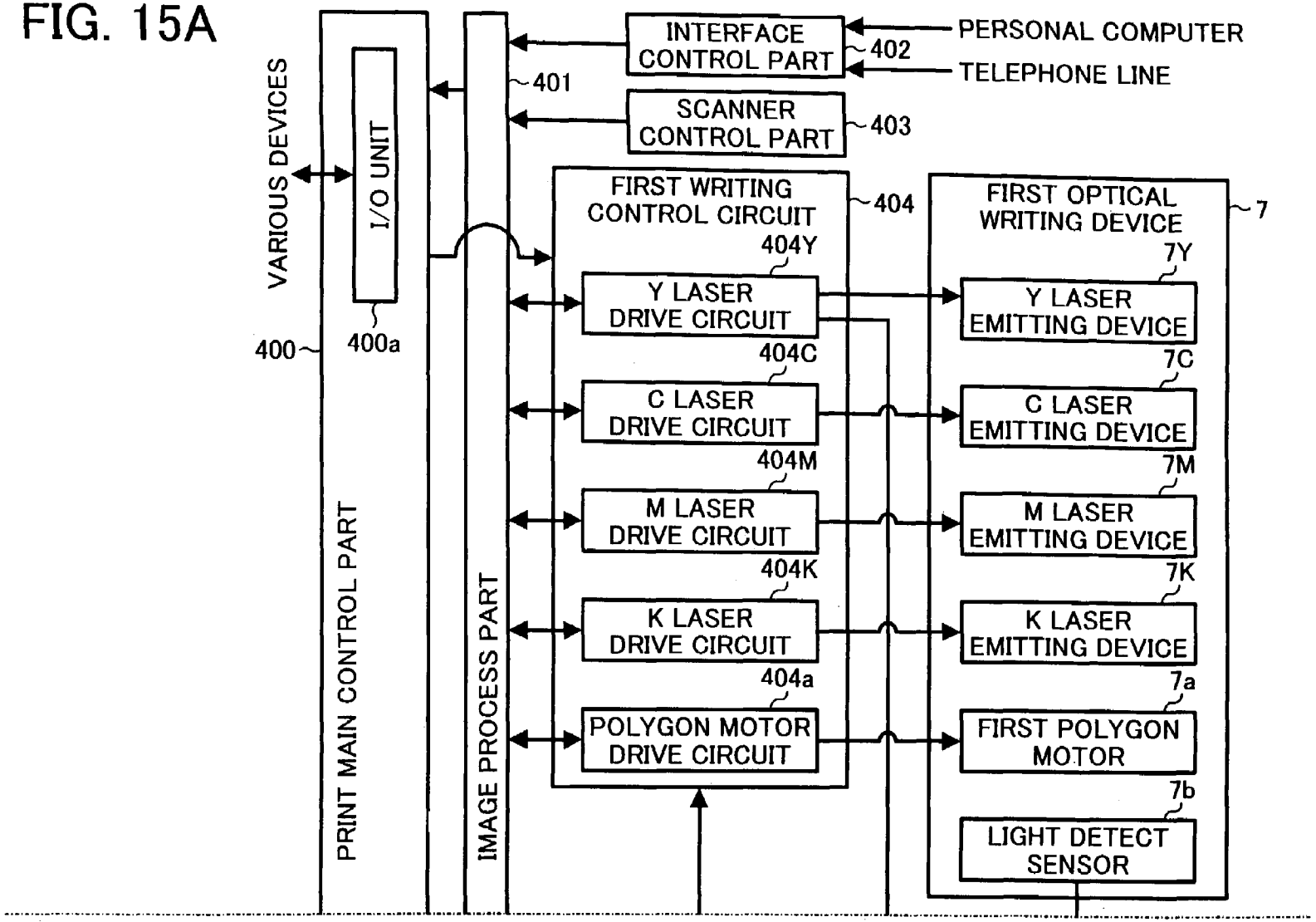
FIG. 15A is a block diagram illustrating a part of an electric circuit of the copying machine having the printer part with the configuration shown in FIG. 14.
Figure 15B:
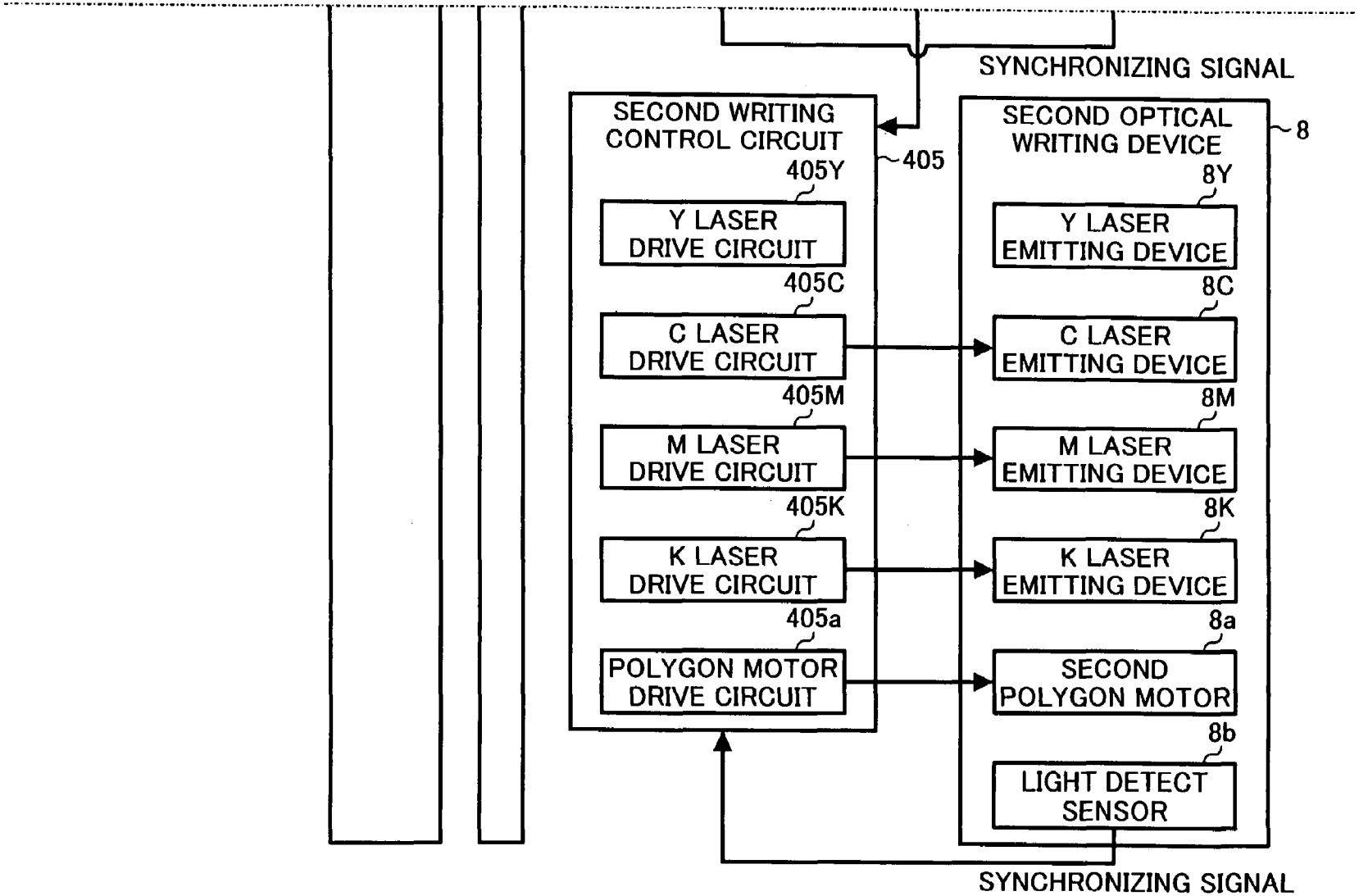
FIG. 15B is a block diagram illustrating another part of the electric circuit of the copying machine having the printer part with the configuration shown in FIG. 14.

FIG. 15A is a portion of a block diagram illustrating a part of an electric circuit of the printer part 100 having the above-described configuration, and FIG. 15B is another portion of the block diagram. The first writing control circuit 404 includes a yellow (Y) laser drive circuit 404Y, a cyan (C) laser drive circuit 404C, a magenta (M) laser drive circuit 404M, and a black (K) laser drive circuit 404K, serving as the first independent control parts, and a polygon motor drive circuit 404*a*. The yellow, cyan, magenta, and black laser drive circuits 404Y, 404C, 404M, and 404K control driving of a yellow (Y) laser emitting device 7Y, a cyan (C) laser emitting device 7C, a magenta (M) laser emitting device 7M, and a black (K) laser emitting device 7K of the first optical writing device 7. The polygon motor drive circuit 404*a* controls a driving of a first polygon motor 7*a* that rotates a polygon mirror (not shown) of the first optical writing device 7.

The polygon mirror of the first optical writing device 7 is formed in a polygon shape and has six light reflecting surfaces. Respective laser lights emitted from the yellow, cyan, magenta, and black laser emitting devices 7Y, 7C, 7M, and 7K are deflected by being reflected by the reflecting surfaces of the polygon mirror which is rotating, and thereby the first photoconductors 1Y, 1C, 1M, and 1K, respectively drum-shaped, are optically scanned with the laser lights in the main scanning directions (the axial directions of the drum-shaped photoconductors).

The first optical writing device 7 includes the yellow, cyan, magenta, and black laser emitting devices 7Y, 7C, 7M, and 7K, the first polygon motor 7*a*, and a light detect sensor 7*b*. The light detect sensor 7*b* is arranged in the vicinity of the first photoconductor 1Y, detects a yellow laser light scanning the first photoconductor 1Y at a predetermined deflection position, and transmits a synchronizing signal to the first optical writing device 7. Immediately after the synchronizing signal has been transmitted, the yellow laser light reaches a writing start position on the first photoconductor 1Y in the main scanning direction.

The second writing control circuit 405 controls the second optical writing device 8 corresponding to the second process units. The configuration of the second writing control circuit 405 being substantially the same as that of the first writing control circuit 404, the description thereof is omitted.

In the copying machine with the printer part 100 having the above-described configuration, by performing control flows similar to those of FIG. 10 through FIG. 13, the deviation in the positions of the images formed on the first and second sides of the transfer sheet P in the conveyance direction of the transfer sheet P can be suppressed. However, in writing latent images using a laser method as in the printer part 100 having the above-described configuration, writing a latent image needs to be started synchronized with the synchronizing signal in the main scanning direction. For example, in FIG. 11, immediately after the writing process has been started, first it is waited for a synchronizing signal from the first optical writing device 7 to be received, and the information request signal is transmitted after receiving the synchronizing signal. In FIG. 12 and FIG. 13 also, the information request signal is transmitted after the synchronizing signal has been received.

Now, a copying machine according to another embodiment of the present invention is described. The configuration of the copying machine in this embodiment is substantially the same as that of the copying machine according to the previous embodiment unless specifically described below.

The yellow writing circuit 404Y of the first writing control circuit 404 (FIG. 7) of the copying machine in this embodiment is configured to perform a control flow similar to the one illustrated in FIG. 11. However, in S24 of FIG. 11, the information request signal is not transmitted to the second writing control circuit 405. Further, each of the cyan writing circuit 404C, the magenta writing circuit 404M, and the black writing circuit 404K of the first writing control circuit 404 is configured to perform a control flow similar to the one illustrated in FIG. 12. Further, the print main control part 400 is configured to transmit the above-described job start signal to the first writing control circuit 404 and the second writing control circuit 405 substantially at the same time.

The yellow writing circuit 405Y of the second writing control circuit 405 is configured to perform a control flow similar to the one illustrated in FIG. 11, which is performed by the yellow writing circuit 404Y of the first writing control circuit 404. However, in S24 of FIG. 11 (when applied to the present embodiment), the information request signal is not transmitted to the second writing control circuit 405. Further, the predetermined period of time in S23 of FIG. 11 is a time corresponding to a time lag between a time when a job start time has arrived and a time when a writing of a second latent image for yellow starts at an appropriate timing in the second process unit.

Each of the cyan writing circuit 405C, the magenta control circuit 405M, and the black writing circuit 405K of the second writing control circuit 405 of the copying machine in this embodiment is configured to perform a control flow similar to the one illustrated in FIG. 12, which is performed by the cyan writing circuit 404C of the first writing control circuit 404. The predetermined period of time in S23 of FIG. 11 corresponds to a time lag between (1) a time when a job start time has arrived, and (2) a time when the writing of a second latent image for cyan starts at an appropriate timing in the second process unit for the cyan writing circuit 405C.

Similarly, the predetermined period of time can correspond to a time lag between (1) a time when a job start time has arrived and (2) a time when the writing of a second latent image for magenta starts at an appropriate timing in the second process unit for the magenta writing circuit 405M or between (1) a time when a job start time has arrived and (2) a time when the writing of a second latent image for black starts at an appropriate timing in the second process unit for the black writing circuit 405K.

Each of the cyan writing circuit 404C, the magenta writing circuit 404M, and the black writing circuit 404K of the first writing control circuit 404 may be configured to determine the timing for starting a writing process thereof based on, instead of the job start signal, the timing for starting a writing process of a writing circuit of the first writing control circuit 404, that starts a writing process thereof before each of the cyan writing circuit 404C, the magenta writing circuit 404M, and the black writing circuit 404K.

Further, each of the cyan writing circuit 405C, the magenta writing circuit 405M, and the black writing circuit 405K of the second writing control circuit 405 may be configured to determine the timing for starting a writing process thereof based on, instead of the job start signal, the timing for starting a writing process of a writing circuit of the second writing control circuit 405, that starts a writing process thereof before each of the cyan writing circuit 405C, the magenta writing circuit 405M, and the black writing circuit 405K.

Furthermore, the yellow writing circuit 404Y of the first writing control circuit 404 and the yellow writing circuit 405Y of the second writing control circuit 405 may be configured to determine the timings for starting respective writing processes based on, instead of the job start signals as described above, writing instruction signals to be transmitted from the print main control part 400. Here, the print main control part 400 is configured to clock the timing for starting a writing process of the yellow writing circuit 404Y of the first writing control circuit 404 and to transmit writing instruction signals to the yellow writing circuit 404Y of the first writing control circuit 404 and the yellow writing circuit 405Y of the second writing control circuit 405 substantially at the same time based on the clocked timing. The yellow writing circuit 404Y and the yellow writing circuit 405Y determine the timings of starting respective writing processes based on the received writing instruction signals. The other writing circuits of the first writing control circuit 404 and the second writing control circuit 405 may be configured to determine the timings for starting respective writing processes based on the above-described writing instruction signals.

In the copying machine of this embodiment, as in the printer part 100 having another configuration in the previous embodiment, a laser writing method may be used by the printer part 100 instead of the method of writing latent images with LED arrays.

Now, a copying machine according to another embodiment of the present invention is described. The configuration of the copying machine according to this embodiment is substantially the same as that of the copying machine according to the first embodiment unless specifically described below.

Figure 16:
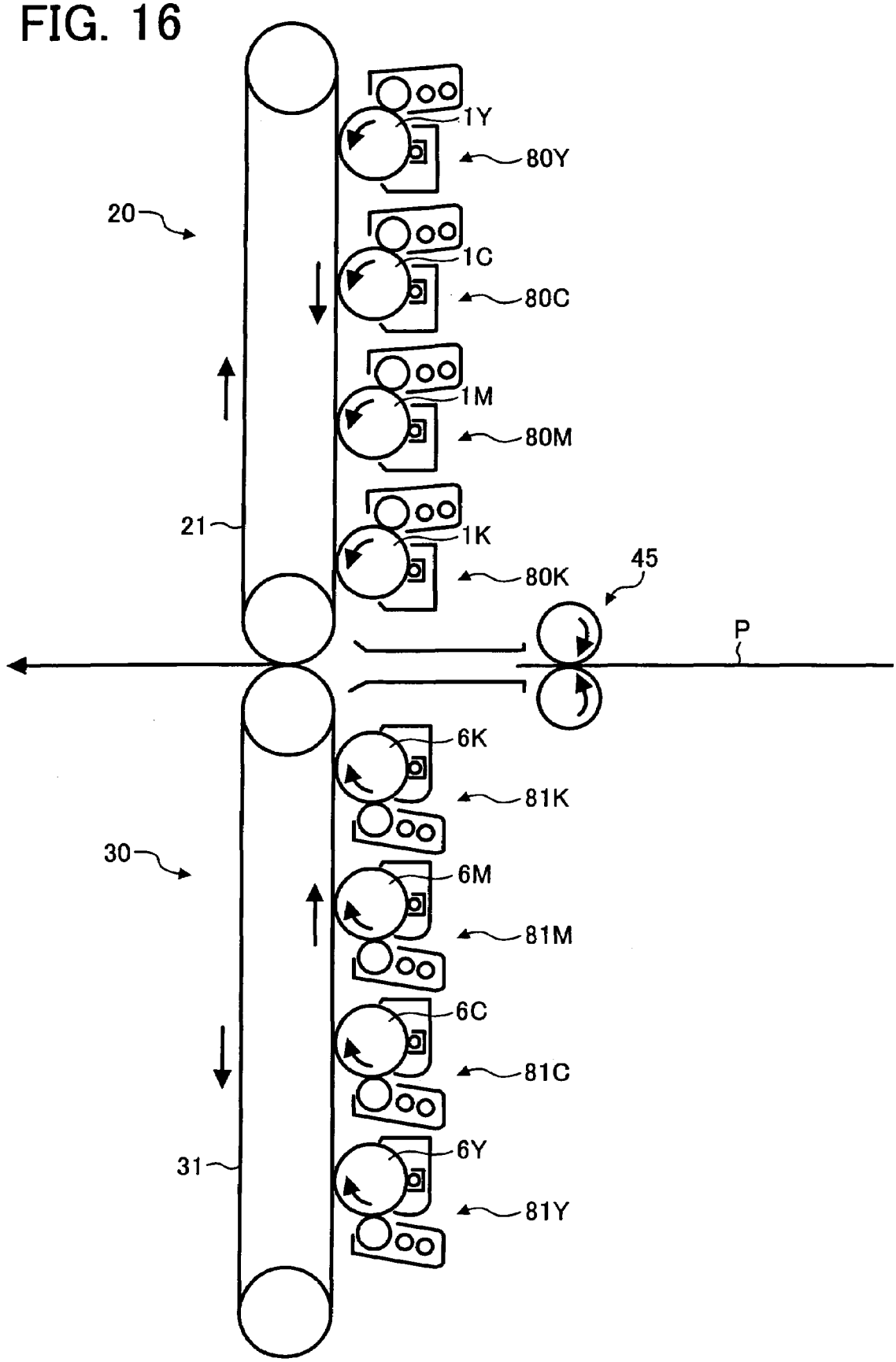
FIG. 16 is a diagram illustrating a part of the printer part of a copying machine according to another embodiment of the present invention.

FIG. 16 is a diagram illustrating a part of the printer part 100 of the copying machine according to this embodiment. In the copying machine, the first transfer unit 20 is configured such that the first intermediary transfer belt 21 is spanned to occupy the space in the vertical direction rather than in the horizontal direction. The first process units 80Y, 80C, 80M, and 80K are arranged to overlap with each other in the vertical direction.

Similarly, the second transfer unit 30 is configured such that the second intermediary transfer belt 31 is spanned to occupy the space in the vertical direction rather than in the horizontal direction. The second process units 81K, 81C, 81M, and 81K are arranged to overlap with each other in the vertical direction. Further, the first transfer unit 20 and the second transfer unit 30 are arranged to overlap each other in the vertical direction.

The second process units 81Y, 81C, 81M, and 81K form images using toner having the polarity reversed to that of the toner used in the first process units 80Y, 80C, 80M, and 80K. The first toner images on the first intermediary transfer belt 21 (formed by overlapping first toner images of yellow, cyan, magenta, and black, developed on the first photoconductors 1Y, 1C, 1M, and 1K of the first process units 80Y, 80C, 80M, and 80K, respectively) are conveyed, as the first intermediary transfer belt 21 is moved, to the secondary transfer nip where the first intermediary transfer belt 21 and the second intermediary transfer belt 31 contact each other. The second toner images on the second intermediary transfer belt 31 (formed by overlapping second toner images of yellow, cyan, magenta, and black, developed on the second photoconductors 6Y, 6C, 6M, and 6K of the second process units 81Y, 81C, 81M, and 81K, respectively) are also conveyed, as the second intermediary transfer belt 31 is moved, to the secondary transfer nip.

On the other hand, the transfer sheet P is conveyed to the secondary transfer nip by the registration roller pair 45 synchronized with the superimposed first toner images and the superimposed second toner images to reach the secondary transfer nip. The superimposed first toner images on the first intermediary transfer belt 21 are brought into a close contact with the first side of the transfer sheet P and the superimposed second toner images on the second intermediary transfer belt 31 are brought into close contact with the second side of the transfer sheet P, at the secondary transfer nip. In this state, the superimposed first toner images are transferred onto the first side of the transfer sheet P under the influence of the secondary transfer electric field and the superimposed second toner images are similarly transferred onto the second side of the transfer sheet P.

As illustrated in FIG. 16, in the copying machine of this embodiment, the distance from the first transfer nip for black, where the first photoconductor 1K contacts the first intermediary transfer belt 21, to the secondary transfer nip where the first intermediary transfer belt 21 and the second intermediary transfer belt 31 contact each other is smaller than the distance from the registration roller pair 45 to the second transfer nip. Further, a writing of a first latent image on the first photoconductor 1K starts after starting a feeding of the transfer sheet P by the registration roller pair 45. A writing of a first toner image on each of the first photoconductors 1Y, 1C, and 1M starts before starting the feeding of the transfer sheet P by the registration roller pair 45.

Further, the distance from the first transfer nip for black, where the second photoconductor 6K contacts the second intermediary transfer belt 31, to the secondary transfer nip is smaller than the distance from the registration roller pair 45 to the secondary transfer nip. Further, a writing of a second latent image on the second photoconductor 6K starts after starting a feeding of the transfer sheet P by the registration roller pair 45. A writing of a second toner image on each of the second photoconductors 6Y, 6C, and 6M starts before starting the feeding of the transfer sheet P by the registration roller pair 45.

The configuration of the first writing control circuit 404 and that of the second writing control circuit 405 of the copying machine are substantially the same as those illustrated in FIG. 7. The yellow writing circuit 404Y, the cyan writing circuit 404C, the magenta writing circuit 404M, and the black writing circuit 404K form the independent control parts of the first writing control circuit 404, and the yellow writing circuit 404Y, the cyan writing circuit 404C, and the magenta writing circuit 404M are the first independent control parts that start respective writing processes prior to the timing for starting feeding the transfer sheet P by the registration roller pair 45.

If the writing processes are started by the yellow writing circuit 404Y, the cyan writing circuit 404C, and the magenta writing circuit 404M after the timing for starting feeding the transfer sheet P, before the toner images formed by the writing processes reach the secondary transfer nip, the transfer sheet P passes the secondary transfer nip. In contrast, the black writing circuit 404K is the first independent control part that starts the writing process after the timing for starting feeding the transfer sheet P by the registration roller pair 45. If the writing process is started by the black writing circuit 404K before the timing for starting feeding the transfer sheet P, before the transfer sheet P reaches the secondary transfer nip, the toner image formed by the writing process enters the secondary transfer nip.

Similarly, the yellow writing circuit 405Y, the cyan writing circuit 405C, the magenta writing circuit 405M, and the black writing circuit 405K form the second independent control parts of the second writing control circuit 405, and the yellow writing circuit 405Y, the cyan writing circuit 405C, and the magenta writing circuit 405M are second independent control parts that start respective writing processes prior to the timing for starting feeding the transfer sheet P by the registration roller pair 45. The black writing circuit 405K is the second independent control part that starts the writing process after the timing for starting feeding the transfer sheet P by the registration roller pair 45.

In the copying machine of this embodiment, when forming color images of black and one or more colors other than black on both sides of the transfer sheet P, control flows similar to those illustrated in FIG. 10 through FIG. 13 are performed. Thereby, the first independent control parts that start respective writing processes prior to the timing for starting feeding the transfer sheet P (i.e., the yellow writing circuit 404Y, the cyan writing circuit 404C, and the magenta writing circuit 404M of the first writing control circuit 404) and the second independent control parts that start respective writing processes prior to the timing for starting feeding the transfer sheet P (i.e., the yellow writing circuit 405Y, the cyan writing circuit 405C, and the magenta writing circuit 405M of the second writing control circuit 405) determine the timings for starting respective writing processes based on the job start signals, respectively.

When forming a first image on the first side of the transfer sheet P by writing a first latent image by controlling a first independent control part that starts the writing process prior to the timing for starting feeding the transfer sheet P and a second image on the second side of the transfer sheet P by writing the second latent image by controlling a second independent control part that starts the writing process prior to the timing for starting feeding the transfer sheet P, the timing for starting driving the registration roller pair 45 is determined based on the timing for starting the writing process of the yellow writing circuit 405Y of the second writing control circuit 405.

When forming the first image on the first side of the transfer sheet P by writing the first latent image by controlling the first independent control part that starts the writing process prior to the timing for starting feeding the transfer sheet P and the second image on the second side of the transfer sheet P by writing the second latent image by controlling the second independent control part that starts the writing process after the timing for starting feeding the transfer sheet P also, the timing for starting driving the registration roller pair 45 is determined based on the timing for starting the writing process of the yellow writing circuit 405Y of the second writing control circuit 405.

Further, when forming the first image on the first side of the transfer sheet P by writing the first latent image by controlling the first independent control part that starts the writing process after the timing for starting feeding the transfer sheet P and the second image on the second side of the transfer sheet P by writing the second latent image by controlling the second independent control part that starts the writing process prior to the timing for starting feeding the transfer sheet P, the timing for starting driving the registration roller pair 45 is determined based on the timing for starting the writing process of the yellow writing circuit 405Y of the second writing control circuit 405.

On the other hand, when forming black-and-white images on both sides of the transfer sheet P, that is, when forming the first image on the first side of the transfer sheet P by writing the first latent image by controlling the first independent control part that starts the writing process after the timing for starting feeding the transfer sheet P and the second image on the second side of the transfer sheet P by writing the second latent image by controlling the second independent control part that starts the writing process after the timing for starting feeding the transfer sheet P, control flows different from those of FIG. 10 through FIG. 13 are performed.

Figure 17:
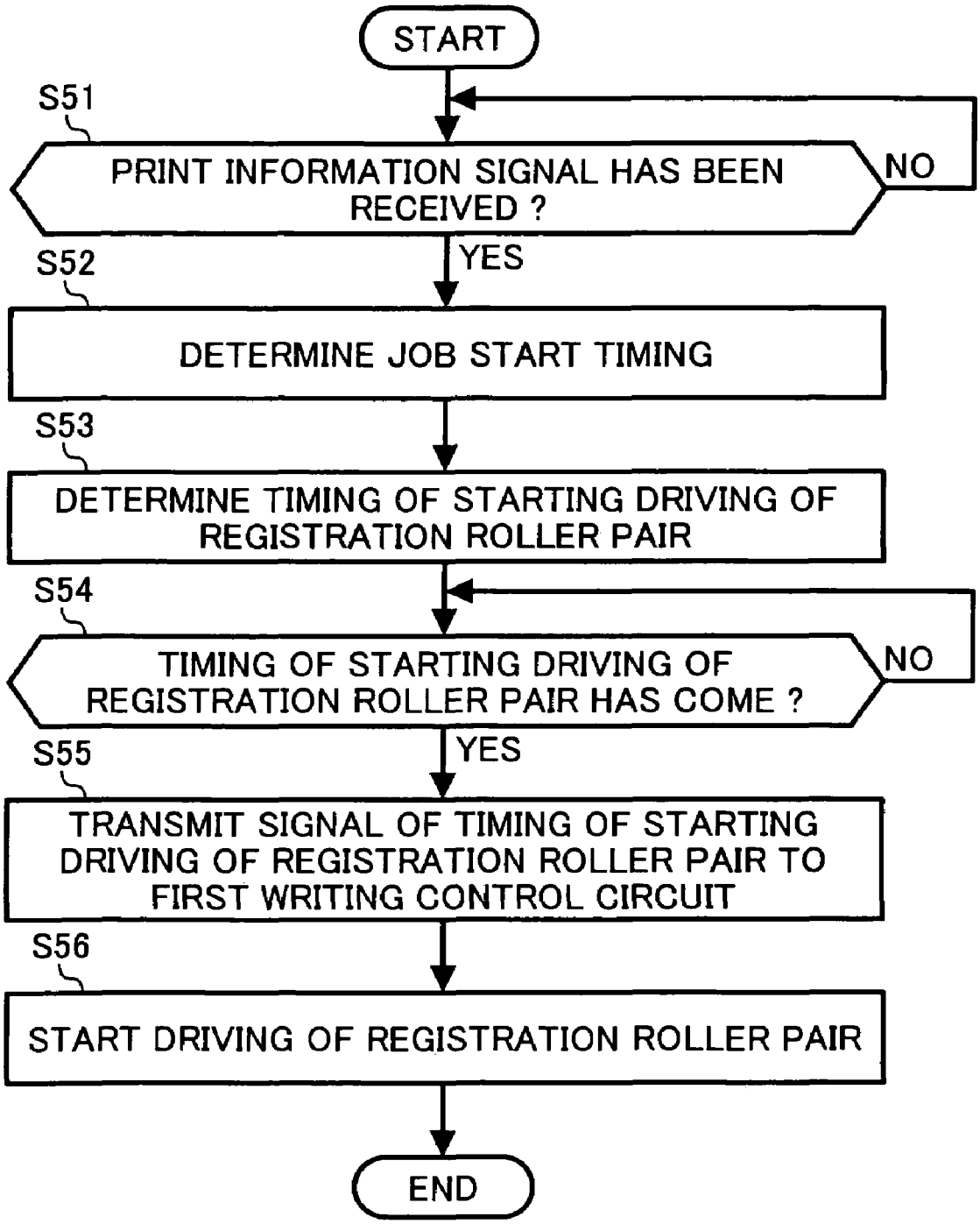
FIG. 17 is a flowchart illustrating a part of a control flow performed by the print main control part of the copying machine when forming a black-and-white image on each side of a transfer sheet.

FIG. 17 is a flowchart illustrating a part of the control flow performed by the print main control part 400 when forming black-and-white images on both of the first side and the second side of the transfer sheet P. The print main control part 400 first determines whether a print information signal has been received from the image process part 401 (S51). When the print information signal has been received, the print main control part 400 determines the job start time based on the received print information signal (S52). Then, the timing for starting driving the registration roller pair 45 is determined based on the job start time (S53). Thereafter, after waiting to receive the timing for starting driving the registration roller pair 45, at the timing for starting driving the registration roller pair 45, a signal of the timing for starting driving the registration roller pair 45 is transmitted to the first writing control circuit 404, and at the same time the driving of the registration roller pair 45 is started (S54, S55, S56).

Figure 18:
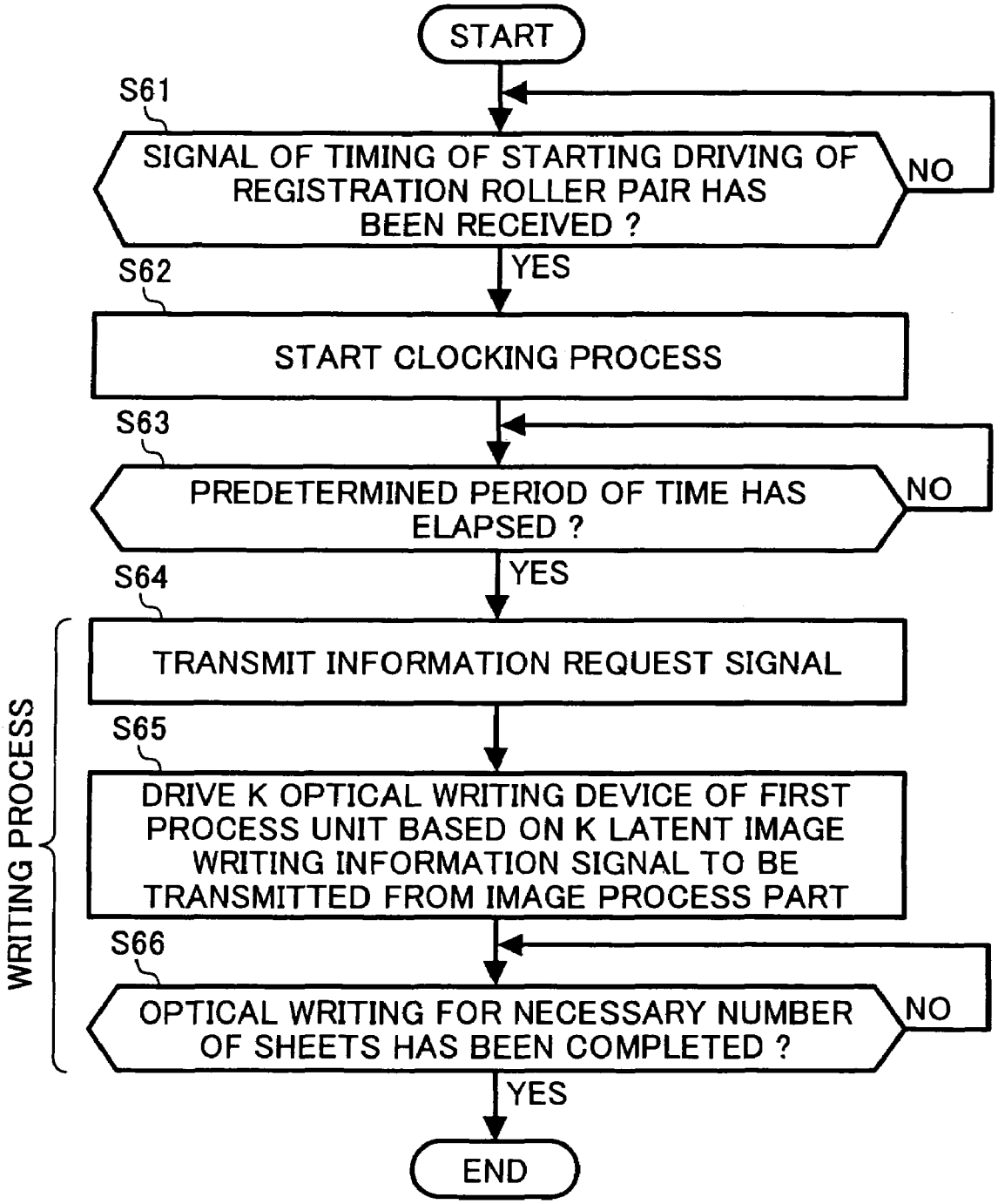
FIG. 18 is a flowchart illustrating a part of a control flow performed by the black writing circuit of the first writing control circuit of the copying machine when forming a black-and-white image on each side of the transfer sheet.

FIG. 18 is a flowchart illustrating a part of a control flow performed by the black writing circuit 404K of the first writing control circuit 404 when forming black-and-white images on both sides of the transfer sheet P. The black writing circuit 404K first waits to receive the signal of the timing for starting driving the registration roller pair 45 to be transmitted from the print main control part 400 (S61). When the signal has been received, a clocking process starts (S62). Thereafter, it is determined whether a predetermined period of time has elapsed (S63). The predetermined period of time corresponds to a time lag between (1) a time corresponding to starting driving the registration roller pair 45 and (2) a time of the writing of the first latent image for black.

When it has been determined in S63 that the predetermined period of time has elapsed, the black writing circuit 404K starts the writing process. In the writing process, first an information request signal is transmitted to the image process part 401 (S64). Then, the black writing circuit 404K drives the black optical writing device 4K of the first process unit to start writing a first latent image for black based on the black latent image writing information signal to be transmitted from the image process part 401 based on the information request signal (S65). Thereafter, it is determined whether an optical writing for the necessary number of sheets has been completed (S66). When the optical writing has been completed, the writing process ends and the control process ends. The information request signal from the black writing circuit 404K is transmitted, in addition to the image process part 401, to the black writing circuit 405K of the second writing control circuit 405.

Figure 19:
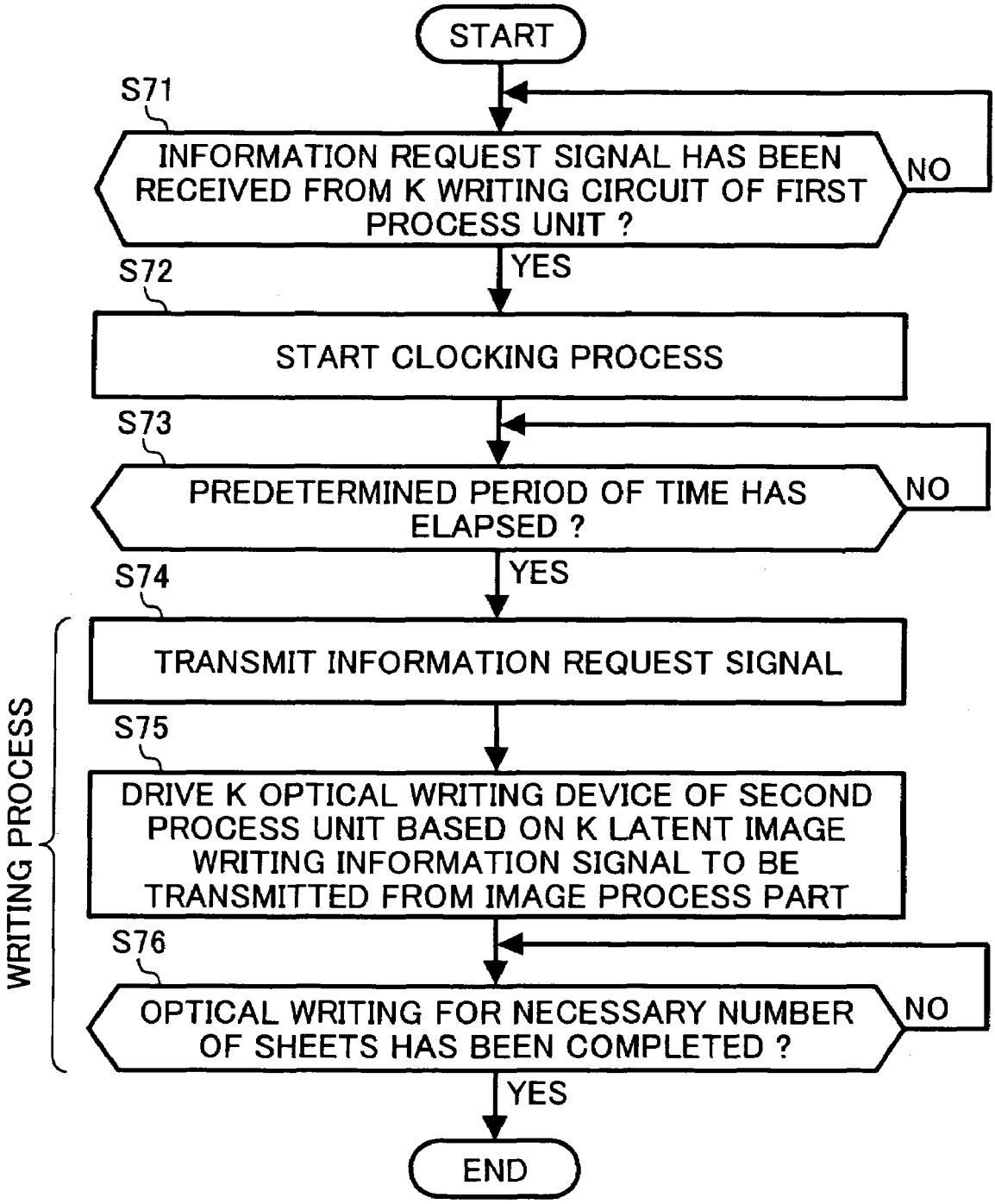
FIG. 19 is a flowchart illustrating a part of a control flow performed by the black writing circuit of the second writing control circuit of the copying machine when forming a black-and-white image on each side of the transfer sheet.

FIG. 19 is a flowchart illustrating a part of a control flow performed by the black writing circuit 405K of the second writing control circuit 405 when forming black-and-white images on both sides of the transfer sheet P. The black writing circuit 405K first waits to receive the information request signal to be transmitted from the black writing circuit 404K of the first writing control circuit 404 (S71). That is, the black writing circuit 405K waits for the timing corresponding to a start of the writing process of the black writing circuit 404K of the first writing control circuit 404. When the timing arrives, a clocking process starts (S72). It is then determined whether a predetermined period of time has elapsed (S73). The predetermined period of time corresponds to a time lag between (1) a time when the black writing circuit 404K of the first writing control circuit 404 has started the writing process, and (2) a time for writing the second latent image for black. When it has been determined in S73 that the predetermined period of time has elapsed, the yellow writing circuit 405Y of the second writing control circuit 405 starts the writing process.

In the writing process, first, an information request signal is transmitted to the image process part 401 (S74). The black optical writing device 4K of the second process unit is driven to start the optical writing of a second latent image for black based on a black latent image writing information signal to be transmitted from the image process unit 401 based on the information request signal (S75). It is then determined whether the optical writing for the necessary number of sheets has been completed (S76). When the optical writing has been completed, the writing process ends and the control flow ends.

Now, a copying machine according to another embodiment of the present invention is described. The configuration of the copying machine according to this embodiment is substantially the same as that of the copying machine according to the previous embodiment unless specifically described below.

In S55 of FIG. 17, when the print main control part 400 transmits a signal of the timing for starting driving the registration roller pair 45 to the black writing circuit 404K, the print main control part 400 also transmits the signal to the black writing circuit 405K at the same time. Further, in S71 of FIG. 19, the black writing circuit 405K waits to receive the signal of the timing for starting driving the registration roller pair 45 from the print main control part 100 instead of an information request signal from the black writing circuit 404K.

As described above, in the copying machine of each embodiment, the first photoconductors 1Y, 1C, 1M, and 1K and the second photoconductors 6Y, 6C, 6M, and 6K are provided to serve as the plurality of first latent image bearing members and the plurality of second latent image bearing members. Further, the optical writing devices 4 of the first process units serving as the first latent image writing device are arranged to write first latent images on the plurality of first latent image bearing members, and the optical writing devices 4 of the second process units serving as the second latent image writing device are arranged to write second latent images on the plurality second latent image bearing members.

The combination of the first transfer unit 20 and the second transfer unit 30 serving as the both-sides transfer device is configured to transfer a first toner image as a first visible image formed on each of the plurality of first latent image bearing members onto the first side of the transfer sheet P to be superimposed on top of each other and a second toner image as a second visible image formed on each of the plurality of second latent image bearing members onto the second side of the recording medium to be superimposed on top of each other. Furthermore, the yellow writing circuit 404Y, the cyan writing circuit 404C, the magenta writing circuit 404M, and the black writing circuit 404K form the plurality of first independent control parts that independently control a writing of respective first latent images on the plurality of first latent image bearing members. These writing circuits are provided to the first writing control circuit 404 as the first writing control device. The yellow writing circuit 405Y, the cyan writing circuit 405C, the magenta writing circuit 405M, and the black writing circuit 405K form the plurality of second independent control parts that independently control a writing of respective second latent images on the plurality of second latent image bearing members. These circuits are provided to the second writing control circuit 405 as the second writing control device.

With this configuration, a first color image and a second color image respectively formed by superimposing a plurality of toner images of respective colors are formed on the first side and the second side of the recording medium, respectively, by causing the recording medium to pass only once the both-sides transfer device and a fixing device, so that forming color images on both sides of the recording medium at a relatively high speed is realized.

In the copying machine according to the first embodiment, as described above, the print main control part 400 serving as the criterion timing determination device determines the job start time as the criterion timing in a series of image forming operations based on the print information as the image forming instruction and transmits the job start signal as the signal of the criterion timing or the signal of the writing instruction determined based on the criterion timing to the first writing control circuit 404.

The yellow writing circuit 404Y as the first independent control part starting the writing process first among the plurality of first independent control parts is configured to determine the timing for starting the writing process based on the job start signal as the signal of the criterion timing, or the signal of the writing instruction. The cyan writing circuit 404C, the magenta writing circuit 404M, and the black writing circuit 404K serving as the other first independent control parts are configured to determine the timings for starting respective writing processes based on any of (i) the job start signal as the signal of the criterion timing, (ii) the signal of the writing instruction, and (iii) the timing for starting the writing process of one first independent control part of the plurality of first independent control parts or one second independent control part of the second independent control parts, that starts a writing process before each of the other first independent control parts.

Further, the yellow writing circuit 405Y (the second independent control part starting the writing process first among the plurality of second independent control parts) is configured to determine the timing for starting the writing process based on the timing for starting the writing process of any one of the plurality of first independent control parts. The cyan writing circuit 405C, the magenta writing circuit 405M, and the black writing circuit 405K (the other second independent control parts) are configured to determine the timings for starting respective writing processes based on one of (i) the timing for starting the writing process of any one of the plurality of first independent control parts, or (ii) the timing for starting the writing process of one first independent control part or one second independent control part, that starts a writing process before each of the other second independent control parts.

Furthermore, the first writing control circuit 404 is configured by the ASIC dedicated to controlling the writing of the first latent images by the optical writing devices as described above, so that the times between (1) the first writing control circuit 404 has received the job start signal, and (2) respective writing processes are started can be precisely set to predetermined values using an internal clock.

The second writing control circuit 405 is also configured by the ASIC dedicated to controlling the writing of the second latent images by the optical writing devices as described above, so that the times between (1) a time when the second writing control circuit 405 has received a signal of the timing for starting the writing process of the first writing control circuit 404, and (2) times when respective writing processes are started can be precisely set to predetermined values also using the internal clock. Thereby, the times between (1) times when the writing circuits of the first writing control circuit 404 have started respective writing processes, and (2) times when the writing circuits of the second writing control circuit 405 start respective writing processes can be made constant (including zero), respectively.

Therefore, even when the timing for transmitting the job start signal by the print main control part 400 has deviated from a regular timing due to parallel processing of various calculations, the deviation in the positions of the images formed on the first side and the second side of the transfer sheet P in the conveyance direction of the transfer sheet P can be suppressed. Accordingly, even when forming a first color image on the first side of the recording medium by superimposing a plurality of first toner images and a second color image on the second side of the recording medium by superimposing a plurality of second toner images, the deviation in the positions of the first color image on the first side of the recording medium and the second color toner image on the second side of the recording medium can be suppressed.

In the copying machine according to the second embodiment described above, the print main control part 400 is configured to transmit the job start signal or the signal of the writing instruction to the second writing control circuit 405 at the same time when transmitting the job start signal or the signal of the writing instruction to the first writing control circuit 404. The yellow writing circuit 404Y, the first independent control part starting the writing process first among the plurality of first independent control parts, is configured to determine the timing for starting the writing process based on the job start signal or the signal of the writing instruction.

The cyan writing circuit 404C, the magenta writing circuit 404M, and the black writing circuit 404K, the other first independent control parts, are configured to determine the timings of starting respective writing processes based on any of (i) the job start signal, (ii) the signal of the writing instruction, or (iii) the timing for starting the writing process of one first independent control part or one second independent control part, that starts the writing process before each of the other first independent control parts.

Further, the yellow writing circuit 405Y, as the second independent control part starting the writing process first among the plurality of second independent control parts, is configured to determine the timing for starting the writing process based on the job start signal or the signal of the writing instruction. The cyan writing circuit 405C, the magenta writing circuit 405M, and the black writing circuit 405K (the other second independent control parts), are configured to determine the timings for starting respective writing processes based on any of (i) the job start signal, (ii) the signal of the writing instruction, or (iii) the timing for starting the writing process of one first independent control part or a second independent control part that starts the writing process before each of the other second independent control parts.

Furthermore, the first writing control circuit 404 and the second writing control circuit 405 are configured by the ASICs dedicated to controlling a writing of latent images with respective optical writing devices of the first process units and the second process units, so that the times between (1) times when the first writing control circuit 404 and the second writing control circuit 405 have received the job start signals or the signals of the writing instruction, and (2) times when the writing circuits of the first writing control circuit 404 and the second writing control circuit 405 start respective writing processes can be precisely set to predetermined values by the internal clocks. Thereby, the times between (1) times when the writing circuits of the first writing control circuit 404 have started respective writing processes, and (2) times when the writing circuits of the second writing control circuit 405 start respective writing processes can be made constant (including zero), respectively.

Therefore, even when the timing of transmitting the job start signals or the signals of the writing instruction by the print main control part 400 has deviated from a regular timing due to parallel processing of various calculations, the deviation in the positions of the images formed on the first side and the second side of the transfer sheet P in the conveyance direction of the transfer sheet P can be suppressed.

Accordingly, even when forming a first color image on the first side of the recording medium by superimposing a plurality of first toner images and a second color image on the second side of the recording medium by superimposing a plurality of second toner images, the deviation in the positions of the first color image on the first side of the recording medium and the second color image on the second side of the recording medium can be suppressed.

Further, in the copying machines according to the first and second embodiments, the print main control part 400 is configured to determine the timing for starting driving the registration roller pair 45 as the timing for starting feeding the recording medium based on the timing for starting the writing process of the first writing control circuit 404 (i.e., based on the information request signal to be transmitted from the first writing control circuit 404).

With this configuration, the timing for starting driving the registration roller pair 45 as the timing for starting feeding the recording medium is determined such that a first toner image as a first visible image to be transferred onto to the first side of the recording medium is synchronized with the recording medium at the first transfer part, so that a relative positional deviation between the recording medium and the first toner image can be suppressed. Similarly, a relative positional deviation between the recording medium and a second toner image as a second visible image can be suppressed.

In the copying machines according to the third and fourth embodiments described above, the first writing control circuit 404 and the second writing control circuit 405 are configured such that the yellow writing circuit 404Y, the cyan writing circuit 404C, and the magenta writing circuit 404M (the first independent control parts of the plurality of first independent control parts that start respective writing processes prior to the timing for starting feeding the recording medium) and the yellow writing circuit 405Y, the cyan writing circuit 405C, and the magenta writing circuit 405M (as the second independent control parts of the plurality of second independent control parts, that start respective writing processes prior to the timing for starting feeding the recording medium) determine the timings for starting respective writing processes based on any of (1) the job start signal, (2) the signal of the writing instruction, or (3) the timing for starting the writing process of one first independent control part or one second independent control part that starts a writing process before the each of the first independent control parts or the each of the second independent control parts, respectively.

With this configuration, the situation that first toner images of yellow, cyan, and magenta reach the first transfer part after the recording medium has reached the first transfer part can be avoided. This situation is caused when first independent control parts and second independent control parts that start respective writing processes before the timing for starting feeding the recording medium, in effect start respective writing processes after the timing for starting feeding the recording medium.

In the copying machine according to the third embodiment described above, the first writing control circuit 404 and the second writing control circuit 405 are configured to operate as described below, when forming (1) a first image on the first side of the recording medium by writing a first latent image by controlling only the black writing circuit 404K (as the first independent control part that starts the writing process after the timing for starting feeding the recording medium), and (2) a second image on the second side of the recording medium by writing a second latent image by controlling only the black writing circuit 405K (as the second independent control part, that starts the writing process thereof after the timing of starting feeding a recording medium).

That is, the black writing circuit 404K that starts the writing process after the timing for starting feeding the recording medium determines the timing for starting the writing process based on the timing for starting driving the registration roller pair 45 as the timing for starting feeding the recording medium, and the black writing circuit 405K that starts the writing process after the timing for starting feeding the recording medium determines the timing for starting the writing process based on the timing for starting the writing process of the black writing circuit 404K as the first independent control part starting the writing process after the timing for starting feeding the recording medium.

Further, the first writing control circuit 404 and the second writing control circuit 405 are configured to operate as described below, when forming (1) the first image on the first side of the recording medium by writing (i) first latent images of yellow, cyan, and magenta by controlling the yellow writing circuit 404Y, the cyan writing circuit 404C, and the magenta writing circuit 404M (as the first independent control parts of the plurality of first independent control parts that start respective writing processes prior to the timing for starting feeding the recording medium), and (ii) a first latent image of black by controlling the black writing circuit 404K (as the first independent control part of the plurality of first independent control parts that starts the writing process after the timing for starting feeding the recording medium), and (2) the second image on the second side of the recording medium by writing (i) second latent images of yellow, cyan, and magenta by controlling the yellow writing circuit 405Y, the cyan writing circuit 405C, and the magenta writing circuit 405M (as the second independent control parts of the plurality of second independent control parts that start respective writing processes prior to the timing for starting feeding the recording medium), and (ii) a second latent image of black by controlling the black writing circuit 405K (as the second independent control part of the plurality of second independent control parts that starts the writing process after the timing of starting feeding the recording medium).

That is, the black writing circuit 404K determines the timing for starting a corresponding writing process based on the timing for starting the writing process of one first independent control part of the plurality of first independent control parts or one second independent control part of the plurality of second independent control parts, the one first independent control part or the one second independent control part starting the writing process before the black writing circuit 404K, and the black writing circuit 405K determines the timing for starting a corresponding writing process based on the timing for starting the writing process of one first independent control part or one second independent control part, the one first independent control part or the one second independent control part starting the writing process before the black writing circuit 405K.

With this configuration, when forming black-and-white images on both sides of the recording medium by controlling the black writing circuit 404K (that starts the writing process after the timing for starting feeding the recording medium) and the black writing circuit 405K (that starts the writing process after the timing for starting feeding the recording medium), the timings for starting respective writing processes can be determined prior to the timing for starting driving the registration roller pair 45.

Further, when forming color images on both sides of the recording medium by superimposing a toner image of black and toner images of other colors, the black writing circuit 404K (that starts the writing process after the timing for starting feeding the recording medium) and the black writing circuit 405K (that starts the writing process after the timing for starting feeding the recording medium) can determine the timings for starting respective writing processes based on the timings for starting the writing processes of the other independent control parts, instead of the timing for starting driving the registration roller pair 45, which is determined by the print main control part 400.

Thus, a situation is avoided that the black writing circuit 404K and the other independent control parts determine respective writing processes based on the timing determined by the print main control part 400. Thereby, even when the timing of transmitting the signal indicative of the timing for starting driving the registration roller pair 45 by the print main control part 400 has deviated from a regular timing due to parallel processing of various calculations at the print main control part 400, the deviation in the positions of the images formed on the first side and the second side of the recording medium in the conveyance direction of the recording medium can be suppressed.

In the copying machine according to the fourth embodiment described above, when forming a first image on the first side of the recording medium by writing a first latent image by controlling only the black writing circuit 404K (that starts the writing process after the timing for starting feeding the recording medium), and a second image on the second side of the recording medium by writing a second latent image by controlling only the black writing circuit 405K (that starts the writing process after the timing for starting feeding the recording medium), both the black writing circuits 404K and 405K start the writing process based on the timing for starting feeding the recording medium.

When obtaining (1) a first image on the first side of the recording medium by forming (i) first latent images of yellow, cyan and magenta by controlling the yellow writing circuit 404Y, the magenta writing circuit 404C, and the magenta writing circuit 404M (that start respective writing processes before the timing for starting feeding the recording medium), and (ii) a first latent image of black by controlling the black wiring circuit 404K (that starts the writing process after the timing for starting feeding the recording medium), and (2) a second image on the second side of the recording medium by forming (i) second latent images for yellow, cyan, and magenta with control of the yellow writing circuit 405Y, the cyan writing circuit 405C, and the magenta writing circuit 405M (that start respective writing processes prior to the timing for starting feeding the recording medium), and (ii) a second latent image for black by controlling the black writing circuit 405K (that starts the writing process after the timing of starting feeding a recording medium), the black writing circuit 404K starts the writing process based on the timing for starting the writing process of one first independent control part or one second independent control part, that starts the writing process before the black writing circuit 404K, and the black writing circuit 405K starts the writing process based on the timing for starting the writing process of another one first independent control part or another one second independent control part (that starts the writing process before the black writing circuit 405K).

With this configuration, when forming black-and-white images on both sides of the recording medium by controlling the black writing circuit 404K and the black writing circuit 405K as the first independent control part and the second independent control part, respectively, the black writing circuit 404K and the black writing circuit 405K can determine the timings for starting respective writing processes prior to the timing for starting driving the registration roller pair 45.

Further, when obtaining color images on both sides of the recording medium by superimposing a toner image of black and toner images of the other colors, the black writing circuit 404K and the black writing circuit 405K determine the timings for starting respective writing processes based on the timings for starting the writing processes of the other independent control parts, instead of the timing for starting driving the registration roller pair 45 determined by the print main control part 400.

Thus, the situation that the black writing circuit 404K, the black writing circuit 405K, and the other independent control parts determine respective writing processes based on the timing determined by the print main control part 400 is avoided.

Thereby, even when the timing of transmitting the signals of the timing for starting driving the registration roller pair 45 by the print main control part 400 has deviated from a regular timing due to parallel processing of various calculations at the print main control part 400, the deviation of the positions of the images on the first side and the second side of the recording medium in the conveyance direction of the recording medium can be suppressed.

The timing for starting a writing process here refers to the time at which a respective writing control device starts a process of causing a latent image writing device to write a latent image on a photoconductor, that is, the time at which the information request signal is transmitted, and an actual optical writing on the photoconductor does not necessarily start at this timing.

Numerous additional modifications and variations of the present invention are possible in light of the above-teachings. It is therefore to be understood that within the scope of the claims, the present invention can be practiced otherwise than as specifically described herein.

The invention claimed is:

1. An image forming apparatus, comprising:

a first writing control device configured to control a writing of a first latent image;

a second writing control device configured to control a writing of a second latent image;

and a criterion timing determination device configured to determine a criterion timing for a series of image forming operations based on an image forming instruction and to transmit to the first writing control device one of (i) a signal of the criterion timing, or (ii) a signal of a writing instruction determined based on the criterion timing, wherein the first writing control device is configured to start a writing process of the first latent image based on one of the signal of the criterion timing or the signal of the writing instruction received from the criterion timing determination device, and to transmit a signal of a timing for starting a writing process to the second writing control device, wherein the second writing control device is configured to start the writing process of the second latent image based on the signal of the timing for starting the writing process received from the first writing control device, wherein the first writing control device includes a plurality of first independent control parts, each first independent control part configured to independently control a writing of a corresponding first latent image on a corresponding first latent image bearing member of a plurality of first latent image bearing members, wherein the second writing control device includes a plurality of second independent control parts, each second independent control part configured to independently control a writing of a corresponding second latent image on a corresponding second latent image bearing member of a plurality of second latent image bearing members, and wherein the first writing control device and the second writing control device are configured such that, a first independent control part of the plurality of first independent control parts, that starts first a writing process among the plurality of first independent control parts, starts the writing process based on one of (i) the signal of the criterion timing, or (ii) the signal of the writing instruction, each of the first independent control parts other than the first independent control part of the plurality of first independent control parts starts a writing process based on any of (1) the signal of the criterion timing, (2) the signal of the writing instruction, or (3) a timing for starting a writing process of one first independent control part of the plurality of first independent control parts or one second independent control part of the plurality of second independent control parts, the one first independent control part or the one second independent control part starting the writing process before the each of the first independent control parts other than the first independent control part, a second independent control part of the plurality of second independent control parts, that starts first a writing process among the plurality of second independent control parts starts the writing process based on a timing for starting the writing process of any one of the plurality of first independent control parts, and each of the second independent control parts other than the second independent control part starts a writing process based on one of (1) a timing for starting the writing process of any one of the plurality of first independent control parts, or (2) a timing for starting a writing process of one first independent control part of the plurality of first independent control parts or one second independent control part of the plurality of second independent control parts, the one first independent control part or the one second independent control part starting the writing process before the each of the second independent control parts other than the second independent control part.

2. The image forming apparatus according to claim 1, further comprising:

a first latent image bearing member;

a first latent image writing device configured to write the first latent image on the first latent image bearing member;

a first development device configured to develop the first latent image on the first latent image bearing member into a first visible image;

a second latent image bearing member;

a second latent image writing device configured to write the second latent image on the second latent image bearing member;

a second development device configured to develop the second latent image on the second latent image bearing member into a second visible image;

a both-sides transfer device configured to transfer the first visible image from the first latent image bearing member onto a first side of a recording medium and the second visible image from the second latent image bearing member onto a second side of the recording medium; and a feed device configured to feed the recording medium to the both-sides transfer device, wherein the first latent image bearing member comprises a plurality of first latent image bearing members and the second latent image bearing member comprises a plurality of second latent image bearing members, wherein the first latent image writing device is configured to write the first latent image on each of the plurality of first latent image bearing members, wherein the second latent image writing device is configured to write the second latent image on each of the plurality of second latent image bearing members, and wherein the both-sides transfer device is configured to transfer the first visible image from each of the plurality of first latent image bearing members onto the first side of the recording medium to be superimposed on top of each other, and to transfer the second visible image from each of the plurality of second latent image bearing members onto the second side of the recording medium to be superimposed on top of each other.

3. The image forming apparatus according to claim 1, wherein the criterion timing determination device is configured to determine a timing for starting feeding a recording medium from a feed device based on the timing for starting the writing process of the first writing control device or the second writing control device.

4. An image forming apparatus, comprising:

a first writing control device configured to control a writing of a first latent image;

a second writing control device configured to control a writing of a second latent image; and a criterion timing determination device configured to determine a criterion timing for a series of image forming operations based on an image forming instruction and to transmit substantially at the same time to the first writing control device and the second writing control device one of (i) a signal of the criterion timing, or (ii) a signal of a writing instruction determined based on the criterion timing, wherein the first writing control device is configured to start a writing process of the first latent image based on one of the signal of the criterion timing, or the signal of the writing instruction, received from the criterion timing determination device, wherein the second writing control device is configured to start the writing process of the second latent image based on one of the signal of the criterion timing, or the signal of the writing instruction received from the criterion timing determination device, wherein the first writing control device includes a plurality of first independent control parts, each first independent control part configured to independently control a writing of a corresponding first latent image on a corresponding first latent image bearing member of a plurality of first latent image bearing members, wherein the second writing control device includes a plurality of second independent control parts, each second independent control part configured to independently control a writing of a corresponding second latent image on a corresponding second latent image bearing member of a plurality of second latent image bearing members, and wherein the first writing control device and the second writing control device are configured such that, a first independent control part of the plurality of first independent control parts, that starts first a writing process among the plurality of first independent control parts starts the writing process based on one of the signal of the criterion timing, or the signal of the writing instruction, each of the first independent control parts other than the first independent control part of the plurality of first independent control parts starts a writing process based on any of (i) the signal of the criterion timing, (ii) the signal of the writing instruction, or (iii) a timing for starting a writing process of one first independent control part of the plurality of first independent control parts or one second independent control part of the plurality of second independent controls parts, the one first independent control part or the one second independent control part starting the writing process before the each of the first independent control parts other than the first independent control part, a second independent control part of the plurality of second independent control parts that starts first a writing process among the plurality of second independent control parts starts the writing process based on one of the signal of the criterion timing, or the signal of the writing instruction, and each of the second independent control parts other than the second independent control part of the plurality of second independent control parts starts a writing process based on one of (i) the signal of the criterion timing, (ii) the signal of the writing instruction, or (iii) a timing for starting a writing process of one first independent control part of the plurality of first independent control parts or one second independent control part of the plurality of second independent control parts, the one first independent control part or the one second independent control part starting the writing process before the each of the second independent control parts other than the second independent control part.

5. The image forming apparatus according to claim 4, further comprising:

a first latent image bearing member;

a first latent image writing device configured to write the first latent image on the first latent image bearing member;

a first development device configured to develop the first latent image on the first latent image bearing member into a first visible image;

a second latent image bearing member; a second latent image writing device configured to write the second latent image on the second latent image bearing member;

a second development device configured to develop the second latent image on the second latent image bearing member into a second visible image;

a both-sides transfer device configured to transfer the first visible image from the first latent image bearing member onto a first side of a recording medium and the second visible image from the second latent image bearing member onto a second side of the recording medium; and a feed device configured to feed the recording medium to the both-sides transfer device, wherein the first latent image baring member comprises a plurality of first latent image bearing members, wherein the second latent image bearing member comprises a plurality of second latent image bearing members, wherein the first latent image writing device is configured to write the first latent image on each of the plurality of first latent image bearing members, wherein the second latent image writing device is configured to write the second latent image on each of the plurality of second latent image bearing members, and wherein the both-sides transfer device is configured to transfer the first visible image from each of the plurality of first latent image bearing members onto the first side of the recording medium to be superimposed on top of each other, and to transfer the second visible image from each of the plurality of second latent image bearing members onto the second side of the recording medium to be superimposed on top of each other.

6. The image forming apparatus according to claim 4, wherein the criterion timing determination device is configured to determine a timing for starting feeding a recording medium from a feed device based on a timing for starting the writing process of the first writing control device or the second writing control device.

7. An image forming apparatus, comprising:

a first writing control device configured to control a writing of a first latent image;

a second writing control device configured to control a writing of a second latent image;

a feed device configured to feed a recording medium to a both-sides transfer device; and a criterion timing determination device configured to determine a criterion timing for a series of image forming operations and a timing for starting feeding the recording medium from the feed device, based on an image forming instruction, and to transmit to the first writing control device any of (i) a signal of the criterion timing, (ii) a signal of a writing instruction determined based on the criterion timing, or (iii) a signal of the timing for starting feeding the recording medium, wherein the first writing control device is configured to start a corresponding writing process based on the signal of the timing for starting feeding the recording medium received from the criterion timing determination device, and to transmit a signal of a timing for starting the writing process to the second writing control device, wherein the second writing control device is configured to start a corresponding writing process based on the signal of the timing for starting the writing process of the first writing control device received from the first writing control device, wherein the first writing control device includes a plurality of first independent control parts, each first independent control part configured to independently control a writing of a corresponding first latent image on a corresponding first latent image bearing member of a plurality of first latent image bearing members, wherein the second writing control device includes a plurality of second independent control parts, each second independent control part configured to independently control a writing of a corresponding second latent image on a corresponding second latent image bearing member of a plurality of second latent image bearing members, and wherein the first writing control device is configured such that, each of the first independent control parts that starts a respective writing process prior to the timing for starting feeding the recording medium, starts the respective writing process based on any of (i) the signal of the criterion timing, (ii) the signal of the writing instruction, or (iii) a timing for starting a writing process of one first independent control part of the plurality of first independent control parts or one second independent control part of the plurality of second independent controls parts, the one first independent control part or the one second independent control part starting a writing process before the each of the first independent control parts.

8. The image forming apparatus according to claim 7, further comprising:

a first latent image bearing member;

a first latent image writing device configured to write the first latent image on the first latent image bearing member;

a first development device configured to develop the first latent image on the first latent image bearing member into a first visible image;

a second latent image bearing member;

a second latent image writing device configured to write the second latent image on the second latent image bearing member;

a second development device configured to develop the second latent image on the second latent image bearing member into a second visible image; and the both-sides transfer device configured to transfer the first visible image from the first latent image bearing member onto a first side of the recording medium to form a first image on the first side of the recording medium, and the second visible image from the second latent image bearing member onto a second side of the recording medium to form a second image on the second side of the recording medium, wherein the first latent image bearing member comprises a plurality of first latent image bearing members, wherein the second latent image bearing member comprises a plurality of second latent image bearing members, wherein the first latent image writing device is configured to write the first latent image on each of the plurality of first latent image bearing members, wherein the second latent image writing device is configured to write the second latent image on each of the plurality of second latent image bearing members, and wherein the both-sides transfer device is configured to transfer the first visible image from each of the plurality of first latent image bearing members onto the first side of the recording medium to be superimposed on top of each other to form the first image and to transfer the second visible image from each of the plurality of second latent image bearing members onto the second side of the recording medium to be superimposed on top of each other to form the second image.

9. The image forming apparatus according to claim 7, wherein the first writing control device and the second writing control device are configured such that, when forming a first image on the first side of the recording medium by writing the first latent image by controlling only a first independent control part of the plurality of independent control parts, that starts a writing process after the timing for starting feeding the recording medium, and a second image on the second side of the recording medium by writing the second latent image by controlling only a one second independent control part of the plurality of second independent control parts, that starts a writing process after the timing for starting feeding the recording medium, the first independent control part starts the writing process based on the timing for starting feeding the recording medium, and the second independent control part starts the writing process based on a timing for starting the writing process of the first independent control part.

10. The image forming apparatus according to claim 7, wherein the first writing control device and the second writing control device are configured such that, when (1) forming a first image on the first side of the recording medium by writing the first latent image by controlling (i) each of the first independent control parts other than a first independent control part, that start respective writing processes prior to the timing for starting feeding the recording medium, and (ii) the first independent control part that starts the writing process after the timing for starting feeding the recording medium, and (2) forming a second image on the second side of the recording medium by writing the second latent image by controlling (i) each of the second independent control parts other than a second independent control part, that start respective writing processes prior to the timing for starting feeding the recording medium, and (ii) the second independent control part that starts the writing process after the timing for starting feeding the recording medium, the first independent control part starts the writing process based on a timing for starting a writing process of another first independent control part or another second independent control part, the another first independent control part or the another second independent control part starting a writing process before the first independent control part, and the second independent control part starts the writing process based on a timing for starting the writing process of another first independent control part or another second independent control part, the another first independent control part or the another second independent control part starting a writing process before the second independent control part.

11. The image forming apparatus according to claim 10, wherein the criterion timing determination device is configured such that, when forming (i) a first image on the first side of the recording medium by writing the first latent image by controlling each of the first independent control parts other than the first independent control part, that start respective writing processes prior to the timing for starting feeding the recording medium, and (ii) the second image on the second side of the recording medium by writing the second latent image by controlling each of the second independent control parts other than the second independent control part, that start respective writing processes prior to the timing for starting feeding the recording medium, the timing for starting feeding the recording medium is determined based on a timing for starting the writing process of one of the first independent control parts or the second independent control parts, the first or second independent control parts starting the respective writing processes prior to the timing for starting feeding the recording medium.

12. An image forming apparatus, comprising:

a first writing control device configured to control a writing of a first latent image;

a second writing control device configured to control a writing of a second latent image;

a feed device configured to feed a recording medium to a both-sides transfer device; and a criterion timing determination device configured to determine a criterion timing for a series of image forming operations- and a timing for starting feeding the recording medium from the feed device, based on an image forming instruction, and to transmit substantially at the same time to the first writing control device and the second writing control device any of (i) a signal of the timing for starting feeding the recording medium, (ii) a signal of the criterion timing, or (iii) a signal of a writing instruction determined based on the criterion timing, wherein the first writing control device is configured to start a writing process based on the signal of the timing for starting feeding the recording medium received from the criterion timing determination device, wherein the second writing control device is configured to start a writing process based on the signal of the timing for starting feeding the recording medium received from the criterion timing determination device, wherein the first writing control device includes a plurality of first independent control parts, each first independent control part configured to independently control a writing of a corresponding first latent image on a corresponding first latent image bearing member of a plurality of first latent image bearing members, wherein the second writing control device includes a plurality of second independent control parts, each second independent control part configured to independently control a writing of a corresponding second latent image on a corresponding second latent image bearing member of a plurality of second latent image bearing members, and wherein the first writing control device and the second writing control device are configured such that, each of first independent control parts of the plurality of first independent control parts that starts a respective writing process prior to the timing for starting feeding the recording medium, and each of second independent control parts of the plurality of second independent control parts that starts a respective writing process prior to the timing for starting feeding the recording medium, start respective writing processes based on any of (i) the signal of the criterion timing, (ii) the signal of the writing instruction, or (iii) a timing for starting a writing process of one first independent control part of the plurality of first independent control parts or one second independent control part of the plurality of second independent control parts, the one first independent control part starting a writing process before the each of the first independent control parts and the one second independent control part starting a writing process before the each of the second independent control parts.

13. The image forming apparatus according to claim 12, further comprising:

a first latent image bearing member;

a first latent image writing device configured to write the first latent image on the first latent image bearing member;

a first development device configured to develop the first latent image on the first latent image bearing member into a first visible image;

a second latent image bearing member;

a second latent image writing device configured to write the second latent image on the second latent image bearing member;

a second development device configured to develop the second latent image on the second latent image bearing member into a second visible image; and the both-sides transfer device configured to transfer the first visible image from the first latent image bearing member onto a first side of the recording medium to form a first image on the first side of the recording medium and the second visible image from the second latent image bearing member onto a second side of the recording medium to form a second image on the second side of the recording medium, wherein the first latent image bearing member comprises a plurality of first latent image bearing members, wherein the second latent image bearing member comprises a plurality of second latent image bearing members, wherein the first latent image writing device is configured to write the first latent image on each of the plurality of first latent image bearing members, wherein the second latent image writing device is configured to write the second latent image on each of the plurality of second latent image bearing members, and wherein the both-sides transfer device is configured to transfer the first visible image from each of the plurality of the first latent image bearing members onto the first side of the recording medium to be superimposed on top of each other to form the first image and to transfer the second visible image from each of the plurality of the second latent image bearing members onto the second side of the recording medium to be superimposed on top of each other to form the second image.

14. The image forming apparatus according to claim 12, wherein the first writing control device and the second control device are configured such that, when forming a first image on the first side of the recording medium by writing the first latent image by controlling only a first independent control part of the plurality of first independent control parts, that starts a writing process after the timing for starting feeding the recording medium, and a second image on the second side of the recording medium by forming the second latent image by controlling only a second independent control part of the plurality of second independent control parts, that starts a writing process after the timing for starting feeding the recording medium, both the first and second independent control parts start the corresponding writing process based on the timing for starting feeding the recording medium.

15. The image forming apparatus according to claim 12, wherein the first writing control device and the second control device are configured such that, when forming (1) a first image on the first side of the recording medium by writing the first latent image by controlling (i) each of the first independent control parts that starts a respective writing process prior to the timing for starting feeding the recording medium, and (ii) a first independent control part that starts the writing process after the timing for starting feeding the recording medium, and (2) a second image on the second side of the recording medium by writing the second latent image by controlling (i) each of the second independent control parts that starts a respective writing process prior to the timing for starting feeding the recording medium, and (ii) a second independent control part that starts the writing process after the timing for starting feeding the recording medium, the first independent control part starts the writing process based on a timing for starting a writing process of one first independent control part of the plurality of first independent control parts or one second independent control part of the plurality of second independent control parts, the one first independent control part or the one second independent control part starting a writing process before the first independent control part, and the second independent control part starts the writing process based on a timing for starting a writing process of another first independent control part or another second independent control part, the another first and second independent control parts starting a corresponding writing process before the second independent control part.

16. The image forming apparatus according to claim 12, wherein the criterion timing determination device is configured such that, when forming (i) a first image on the first side of the recording medium by writing the first latent image by controlling each of the first independent control parts that starts a respective writing process prior to the timing for starting feeding the recording medium, and (ii) a second image on the second side of the recording medium by writing the second latent image by controlling each of the second independent control parts that starts a respective writing process prior to the timing for starting feeding the recording medium, the timing for starting feeding the recording medium is determined based on a timing for starting the writing process of one of the first independent control parts or the second independent control parts.

17. A method of controlling an image forming apparatus, comprising:

transmitting to a first writing control device one of (i) a signal of a criterion timing, or (ii) a signal of a writing instructions determined based on the criterion timing from a criterion determination device;

causing the first writing control device to start a writing process based on one of the signal of the criterion timing or the signal of the writing instruction received from the criterion timing determination device, and to transmit a signal of a timing for starting the writing process to a second writing control device; and causing the second control device to start a writing process based on the signal of the timing for starting the writing process received from the first writing control device;

wherein the first writing control device includes a plurality of first independent control parts, each first independent control part configured to independently control a writing of a corresponding first latent image on a corresponding first latent image bearing member of a plurality of first latent image bearing members, wherein the second writing control device includes a plurality of second independent control parts, each second independent control part configured to independently control a writing of a corresponding second latent image on a corresponding second latent image bearing member of a plurality of second latent image bearing members, and wherein the first writing control device and the second writing control device are configured such that, a first independent control part of the plurality of first independent control parts, that starts first a writing process among the plurality of first independent control parts, starts the writing process based on one of (i) the signal of the criterion timing, or (ii) the signal of the writing instruction.

each of the first independent control parts other than the first independent control part of the plurality of first independent control parts starts a writing process based on any of (1) the signal of the criterion timing, (2) the signal of the writing instruction, or (3) a timing for starting a writing process of one first independent control part of the plurality of first independent control parts or one second independent control part of the plurality of second independent control parts, the one first independent control part or the one second independent control part starting the writing process before the each of the first independent control parts other than the first independent control part, a second independent control part of the plurality of second independent control parts, that starts first a writing process among the plurality of second independent control parts starts the writing process based on a timing for starting the writing process of any one of the plurality of first independent control parts, and each of the second independent control parts other than the second independent control part starts a writing process based on one of (1) a timing for starting the writing process of any one of the plurality of first independent control parts, or (2) a timing for starting a writing process of one first independent control part of the plurality of first independent control parts or one second independent control part of the plurality of second independent control parts, the one first independent control part or the one second independent control part starting the writing process before the each of the second independent control parts other than the second independent control part.

18. A method of controlling an image forming apparatus, comprising:

transmitting substantially at the same time to a first writing control device and a second writing control device one of (i) a signal of a criterion timing or (ii) a signal of a writing instruction determined based on the criterion timing from a criterion determination device;

causing the first writing control device to start a writing process based on one of the signal of the criterion timing or the signal of the writing instruction received from the criterion timing determination device; and causing the second writing control device to start a writing process based on one of the signal of the criterion timing or the signal of the writing instruction received from the criterion timing determination device, wherein the first writing control device includes a plurality of first independent control parts, each first independent control part configured to independently control a writing of a corresponding first latent image on a corresponding first latent image bearing member of a plurality of first latent image bearing members, wherein the second writing control device includes a plurality of second independent control parts, each second independent control part configured to independently control a writing of a corresponding second latent image on a corresponding second latent image bearing member of a plurality of second latent image bearing members, and wherein the first writing control device and the second writing control device are configured such that, a first independent control part of the plurality of first independent control parts, that starts first a writing process among the plurality of first independent control parts starts the writing process based on one of the signal of the criterion timing, or the signal of the writing instruction, each of the first independent control parts other than the first independent control part of the plurality of first independent control parts starts a writing process based on any of (i) the signal of the criterion timing, (ii) the signal of the writing instruction, or (iii) a timing for starting a writing process of one first independent control part of the plurality of first independent control parts or one second independent control part of the plurality of second independent controls parts, the one first independent control part or the one second independent control part starting the writing process before the each of the first independent control parts other than the first independent control part, a second independent control part of the plurality of second independent control parts that starts first a writing process among the plurality of second independent control parts starts the writing process based on one of the signal of the criterion timing, or the signal of the writing instruction, and each of the second independent control parts other than the second independent control part of the plurality of second independent control parts starts a writing process based on one of (i) the signal of the criterion timing, (ii) the signal of the writing instruction, or (iii) a timing for starting a writing process of one first independent control part of the plurality of first independent control parts or one second independent control part of the plurality of second independent control parts, the one first independent control part or the one second independent control part starting the writing process before the each of the second independent control parts other than the second independent control part.

19. A method of controlling an image forming apparatus, comprising:

transmitting a signal of a timing for starting feeding a recording medium from a criterion timing determination device to a first writing control device; and causing the first writing control device to start a writing process based on the signal of the timing for starting feeding the recording medium received from the criterion timing determination device, and to transmit a signal of a timing for starting the writing process to a second writing control device; and causing the second writing control device to start a writing process based on the signal of the timing for starting the writing process received from the first writing control device, wherein the first writing control device includes a plurality of first independent control parts, each first independent control part configured to independently control a writing of a corresponding first latent image on a corresponding first latent image bearing member of a plurality of first latent image bearing members, wherein the second writing control device includes a plurality of second independent control parts, each second independent control part configured to independently control a writing of a corresponding second latent image on a corresponding second latent image bearing member of a plurality of second latent image bearing members, and wherein the first writing control device is configured such that, each of the first independent control parts that starts a respective writing process prior to the timing for starting feeding the recording medium, starts the respective writing process based on any of (i) the signal of the criterion timing, (ii) the signal of the writing instruction, or (iii) a timing for starting a writing process of one first independent control part of the plurality of first independent control parts or one second independent control part of the plurality of second independent controls parts, the one first independent control part or the one second independent control part starting a writing process before the each of the first independent control parts.

20. A method of controlling an image forming apparatus, comprising:

transmitting a signal of a timing for starting feeding a recording medium from a criterion timing determination device to a first writing control device and a second writing control device substantially at the same time;

causing the first writing control device to start a writing process based on the signal of the timing for starting feeding the recording medium received from the criterion timing determination device; and causing the second writing control device to start a writing process based on the signal of the timing for starting feeding the recording medium received from the criterion timing determination device, wherein the first writing control device includes a plurality of first independent control parts, each first independent control part configured to independently control a writing of a corresponding first latent image on a corresponding first latent image bearing member of a plurality of first latent image bearing members, wherein the second writing control device includes a plurality of second independent control parts, each second independent control part configured to independently control a writing of a corresponding second latent image on a corresponding second latent image bearing member of a plurality of second latent image bearing members, and wherein the first writing control device and the second writing control device are configured such that, each of first independent control parts of the plurality of first independent control parts that starts a respective writing process prior to the timing for starting feeding the recording medium, and each of second independent control parts of the plurality of second independent control parts that starts a respective writing process prior to the timing for starting feeding the recording medium, start respective writing processes based on any of (i) the signal of the criterion timing, (ii) the signal of the writing instruction, or (iii) a timing for starting a writing process of one first independent control part of the plurality of first independent control parts or one second independent control part of the plurality of second independent control parts, the one first independent control part starting a writing process before the each of the first independent control parts and the one second independent control part starting a writing process before the each of the second independent control parts.

* * * * *